US009455503B2

(12) United States Patent
Mathews et al.

(10) Patent No.: US 9,455,503 B2
(45) Date of Patent: Sep. 27, 2016

(54) ELECTRICAL CONNECTOR CONTACT TERMINAL

(71) Applicant: 3M INNOVATIVE PROPERTIES COMPANY, St. Paul, MN (US)

(72) Inventors: Alexander R. Mathews, Austin, TX (US); Steven A. Neu, Cedar Park, TX (US); Steven Feldman, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/364,447

(22) PCT Filed: Feb. 5, 2013

(86) PCT No.: PCT/US2013/024703

§ 371 (c)(1),
(2) Date: Jun. 11, 2014

(87) PCT Pub. No.: WO2013/119526

PCT Pub. Date: Aug. 15, 2013

(65) Prior Publication Data

US 2014/0377980 A1 Dec. 25, 2014

Related U.S. Application Data

(60) Provisional application No. 61/596,032, filed on Feb. 7, 2012.

(51) Int. Cl.

| | |
|---|---|
| ***H01R 4/24*** | (2006.01) |
| ***H01R 12/67*** | (2011.01) |
| ***H01R 12/79*** | (2011.01) |

(52) U.S. Cl.

CPC ..... *H01R 4/242* (2013.01); *H01R 12/675* (2013.01); *H01R 12/79* (2013.01)

(58) Field of Classification Search

CPC ..... H01R 13/6315; H01R 4/2429

See application file for complete search history.

(56) References Cited

U.S. PATENT DOCUMENTS 3,274,533 A * 9/1966 Apted et al. ..... 439/689
3,404,367 A 10/1968 Henschen (Continued)

FOREIGN PATENT DOCUMENTS

DE 20121422 10/2002
EP 1014505 6/2000

(Continued)

OTHER PUBLICATIONS

International Search Report for PCT International Application No. PCT/2013/024703, mailed on Jun. 2, 2013, 4pgs.

*Primary Examiner* — Gary Paumen
(74) *Attorney, Agent, or Firm* — Robert S. Moshrefzadeh

(57) ABSTRACT

An electrical contact terminal includes a base portion for positioning and retaining the electrical contact terminal within a connector housing, an insulation displacement connecting portion extending upwardly from the base portion and comprising a pair of spaced apart arms defining an opening therebetween for receiving and making electrical contact with an electrical conductor, and a contact portion extending downwardly from the base portion and configured to float when the electrical contact terminal is retained and positioned within a connector housing. The contact portion includes a first arm, a second arm, and an arcuate base portion. The first arm extends downwardly and includes a first end attached to the base portion and an opposite second end. The second arm extends downwardly and includes a free first end closer to the base portion and an opposite second end farther from the base portion. The second arm is configured to deflect when making electrical contact with a mating contact pin. The arcuate base portion connects the second ends of the first and second arms.

30 Claims, 20 Drawing Sheets

(56) References Cited

U.S. PATENT DOCUMENTS

| | | | | |
|---|---|---|---|---|
| 3,699,502 | A | | 10/1972 | Carter |
| 3,930,708 | A | * | 1/1976 | Wedekind et al. ..... 439/397 |
| 4,070,081 | A | | 1/1978 | Takahashi |
| 4,178,051 | A | | 12/1979 | Kocher |
| 4,214,800 | A | | 7/1980 | Hollyday |
| 4,230,384 | A | | 10/1980 | Anhalt |
| 4,241,966 | A | | 12/1980 | Gomez |
| 4,241,970 | A | | 12/1980 | Rider et al. |
| 4,252,399 | A | | 2/1981 | Bauerle |
| 4,362,353 | A | | 12/1982 | Cobaugh |
| 4,379,611 | A | | 4/1983 | Foege |
| 4,410,222 | A | | 10/1983 | Enomoto |
| 4,444,450 | A | | 4/1984 | Huber |
| 4,472,017 | A | | 9/1984 | Sian |
| 4,484,791 | A | | 11/1984 | Johnson |
| 4,531,795 | A | | 7/1985 | Sinclair |
| 4,538,873 | A | | 9/1985 | Worth |
| 4,539,889 | A | | 9/1985 | Glock |
| 4,553,808 | A | | 11/1985 | Weidler |
| 4,579,408 | A | | 4/1986 | Sasaki |
| 4,621,885 | A | | 11/1986 | Szczesny |
| 4,634,210 | A | | 1/1987 | Crawford |
| 4,767,352 | A | | 8/1988 | Pretchel |
| 4,781,615 | A | | 11/1988 | Davis |
| 4,825,744 | A | | 5/1989 | Glock |
| 4,834,665 | A | | 5/1989 | Kreinberg |
| 4,850,904 | A | | 7/1989 | Shimizu |
| 4,915,645 | A | | 4/1990 | Konnemann |
| 4,946,390 | A | | 8/1990 | Smyers |
| 4,957,451 | A | | 9/1990 | Nadin |
| 4,973,255 | A | | 11/1990 | Rudoy |
| 5,017,149 | A | | 5/1991 | Hatanaka |
| 5,035,656 | A | | 7/1991 | Patel |
| 5,057,029 | A | | 10/1991 | Noorily |
| 5,059,135 | A | | 10/1991 | Matsuoka |
| 5,106,328 | A | | 4/1992 | Prochaska |
| 5,183,421 | A | | 2/1993 | Yin |
| 5,259,785 | A | | 11/1993 | Inaba |
| 5,290,181 | A | | 3/1994 | Bixler |
| 5,380,213 | A | | 1/1995 | Piorunneck |
| 5,516,984 | A | | 5/1996 | Soes |
| 5,584,705 | A | | 12/1996 | Lin |
| 5,637,004 | A | | 6/1997 | Chen |
| 5,639,259 | A | | 6/1997 | Wellinsky |
| 5,655,914 | A | | 8/1997 | McCartin |
| 5,676,561 | A | | 10/1997 | Chiang |
| 5,683,267 | A | | 11/1997 | Ribbeck |
| 5,702,266 | A | | 12/1997 | Jones |
| 5,741,162 | A | | 4/1998 | Kourimsky |
| 5,746,613 | A | | 5/1998 | Cheng |
| 5,762,513 | A | | 6/1998 | Stine |
| 5,897,401 | A | | 4/1999 | Fili |
| 5,924,883 | A | | 7/1999 | Yamagami |
| 5,960,537 | A | | 10/1999 | Vicich |
| 5,964,596 | A | | 10/1999 | Vicich |
| 5,980,337 | A | | 11/1999 | Little |
| 6,059,585 | A | | 5/2000 | Liao |
| 6,132,241 | A | | 10/2000 | Hwang |
| 6,142,790 | A | | 11/2000 | Niitsu |
| 6,142,821 | A | | 11/2000 | Hwang |
| 6,152,782 | A | | 11/2000 | Volkert |
| 6,155,887 | A | | 12/2000 | Cuff |
| 6,179,642 | B1 | | 1/2001 | Hwang |
| 6,193,541 | B1 | | 2/2001 | Lee |
| 6,200,149 | B1 | | 3/2001 | Chi-Chung |
| 6,220,890 | B1 | | 4/2001 | Turek |
| 6,247,972 | B1 | | 6/2001 | Crane, Jr. |
| 6,250,938 | B1 | | 6/2001 | Tung |
| 6,276,950 | B1 | | 8/2001 | Yodogawa |
| 6,328,585 | B1 | | 12/2001 | Matsuo |
| 6,368,126 | B1 | | 4/2002 | Lee |
| 6,485,330 | B1 | | 11/2002 | Doutrich |
| 6,585,527 | B2 | | 7/2003 | Koopman |
| 6,666,706 | B1 | | 12/2003 | Jones |
| 6,739,884 | B2 | | 5/2004 | Vicich |
| 6,824,396 | B2 | | 11/2004 | Koopman |
| 6,824,408 | B1 | | 11/2004 | Wu |
| 6,851,989 | B2 | | 2/2005 | Maeda |
| 6,899,548 | B2 | | 5/2005 | Houtz |
| 6,916,186 | B2 | | 7/2005 | Szu |
| 6,955,572 | B1 | | 10/2005 | Howell |
| 6,969,286 | B1 | | 11/2005 | Mongold |
| 7,008,250 | B2 | | 3/2006 | Shuey |
| 7,014,475 | B1 | | 3/2006 | Mongold |
| 7,029,287 | B2 | | 4/2006 | Matsunaga |
| 7,125,293 | B2 | | 10/2006 | Mongold |
| 7,137,832 | B2 | | 11/2006 | Mongold |
| 7,147,498 | B1 | | 12/2006 | Gillespie |
| 7,165,994 | B2 | | 1/2007 | Ferry |
| 7,172,438 | B2 | | 2/2007 | Vicich |
| 7,351,117 | B1 | | 4/2008 | Mostoller |
| 7,354,310 | B1 | | 4/2008 | Brown |
| 7,371,129 | B2 | | 5/2008 | Mongold |
| 7,429,178 | B2 | | 9/2008 | Givens |
| 7,445,471 | B1 | | 11/2008 | Scherer |
| 7,445,494 | B2 | | 11/2008 | Wei |
| 7,462,053 | B2 | | 12/2008 | Little |
| 7,470,155 | B1 | | 12/2008 | Soubh |
| 7,479,017 | B1 | | 1/2009 | Koopman |
| 7,544,093 | B2 | | 6/2009 | Soubh |
| 7,549,884 | B2 | | 6/2009 | Soubh |
| 7,563,105 | B2 | | 7/2009 | Liu |
| 7,686,631 | B1 | | 3/2010 | Eow |
| 7,789,681 | B2 | | 9/2010 | Guan |
| 7,815,439 | B2 | | 10/2010 | Klein |
| 2002/0182901 | A1 | | 12/2002 | Koopman |
| 2003/0022555 | A1 | | 1/2003 | Vicich |
| 2003/0096533 | A1 | | 5/2003 | Kojima |
| 2003/0236024 | A1 | | 12/2003 | Wu |
| 2004/0009687 | A1 | | 1/2004 | Vicich |
| 2004/0048504 | A1 | | 3/2004 | Hynes |
| 2004/0137781 | A1 | | 7/2004 | Ye |
| 2004/0192081 | A1 | | 9/2004 | Koopman |
| 2004/0235323 | A1 | | 11/2004 | Ferry |
| 2005/0130490 | A1 | | 6/2005 | Rose |
| 2005/0148225 | A1 | | 7/2005 | Zahlit |
| 2005/0202730 | A1 | | 9/2005 | Kubo |
| 2005/0266721 | A1 | | 12/2005 | Milner |
| 2005/0277221 | A1 | | 12/2005 | Mongold |
| 2005/0287830 | A1 | | 12/2005 | Mongold |
| 2005/0287844 | A1 | | 12/2005 | Mongold |
| 2006/0094308 | A1 | | 5/2006 | Chen |
| 2006/0110951 | A1 | | 5/2006 | Mongold |
| 2006/0196857 | A1 | | 9/2006 | Vicich |
| 2006/0199447 | A1 | | 9/2006 | Vicich |
| 2006/0246785 | A1 | | 11/2006 | Mongold |
| 2007/0042619 | A1 | | 2/2007 | Ferry |
| 2007/0141871 | A1 | | 6/2007 | Scherer |
| 2008/0026618 | A1 | | 1/2008 | Mon |
| 2008/0050955 | A1 | | 2/2008 | Chen |
| 2008/0064266 | A1 | | 3/2008 | Givens |
| 2008/0070441 | A1 | | 3/2008 | Chazottes |
| 2008/0112707 | A1 | | 5/2008 | Mongold |
| 2008/0176432 | A1 | | 7/2008 | Scherer |
| 2008/0180122 | A1 | | 7/2008 | Soubh |
| 2008/0318460 | A1 | | 12/2008 | Hsieh |
| 2009/0023333 | A1 | | 1/2009 | Soubh |
| 2009/0075511 | A1 | | 3/2009 | Givens |
| 2009/0085591 | A1 | | 4/2009 | Soubh |
| 2009/0130890 | A1 | | 5/2009 | Neumetzler |
| 2009/0137161 | A1 | | 5/2009 | Diemer |
| 2009/0186502 | A1 | | 7/2009 | Chen |
| 2009/0215309 | A1 | | 8/2009 | Mongold |
| 2009/0280681 | A1 | | 11/2009 | Mongold |
| 2009/0298315 | A1 | | 12/2009 | Iida |
| 2010/0144177 | A1 | | 6/2010 | Vicich |
| 2010/0173507 | A1 | | 7/2010 | Vicich |
| 2012/0149223 | A1 | | 6/2012 | Feldman |

FOREIGN PATENT DOCUMENTS

| | | |
|---|---|---|
| EP | 1168512 | 1/2002 |
| EP | 1885029 | 6/2008 |
| GB | 2248529 | 4/1992 |

(56) References Cited

FOREIGN PATENT DOCUMENTS

| | | |
|---|---|---|
| JP | S60-059477 | 4/1985 |
| JP | 09120864 | 5/1997 |
| JP | 10223294 | 8/1998 |
| JP | 2001-332346 | 11/2001 |
| JP | 2003-187928 | 7/2003 |
| JP | 3810134 | 8/2006 |
| JP | 2006-260923 | 9/2006 |
| JP | 2006-294394 | 10/2006 |
| JP | 2008-300064 | 12/2008 |
| JP | 4218907 | 2/2009 |
| JP | 3153470 | 9/2009 |
| JP | 3157478 | 2/2010 |
| JP | 3157679 | 2/2010 |
| WO | WO 94-11922 | 5/1994 |
| WO | WO 97-32275 | 9/1997 |
| WO | WO 2013-119522 | 8/2013 |
| WO | WO 2013-119529 | 8/2013 |
| WO | WO 2013-119530 | 8/2013 |
| WO | WO 2013-119533 | 8/2013 |

* cited by examiner

ELECTRICAL CONNECTOR CONTACT TERMINAL

STATEMENT OF PRIORITY

This application claims the priority of U.S. Provisional Application No. 61/596,032 filed 7 Feb. 2012.

TECHNICAL FIELD

The present disclosure relates generally to interconnections made between a printed circuit board and an electrical cable carrying signals to and from the printed circuit board. More particularly, the present disclosure relates to an electrical connector system including an electrical connector for assembly to a printed circuit board and a mating electrical connector for assembly to an electrical cable to facilitate these interconnections.

BACKGROUND

Interconnection between printed circuit boards and electrical cables is known in the art. Such interconnections typically have not been difficult to form, especially when the signal line densities have been relatively low. As user requirements grow more demanding with respect to interconnect sizes, the design and manufacture of interconnects that can perform satisfactorily in terms of physical size has grown more difficult.

A typical method of reducing the interconnect size is to reduce its contact-to-contact spacing, typically referred to as contact pitch. For example, compared to a 0.100" (2.54 mm) pitch interconnect, a 0.050" (1.27 mm) pitch interconnect can provide the same number of electrical connections (i.e., contacts) in half the space. However, typical solutions of smaller pitch interconnects are merely scaled down versions of larger pitch interconnects. These scaled down versions typically have a large overall interconnect size relative to the contact pitch, especially when additional components such as, e.g., a latching/ejecting mechanism or a cable strain relief, are included, are prone to mechanical and electrical reliability issues, are inherently expensive to manufacture, and offer limited to no customization to meet specific end user needs.

Therefore, there is a need in the art for an electrical connector system which can overcome the disadvantages of conventional connector systems.

SUMMARY

In at least one aspect, the present invention provides an electrical contact terminal including a base portion for positioning and retaining the electrical contact terminal within a connector housing, an insulation displacement connecting portion extending upwardly from the base portion and comprising a pair of spaced apart arms defining an opening therebetween for receiving and making electrical contact with an electrical conductor, and a contact portion extending downwardly from the base portion and configured to float when the electrical contact terminal is retained and positioned within a connector housing. The contact portion includes a first arm, a second arm, and an arcuate base portion. The first arm extends downwardly and includes a first end attached to the base portion and an opposite second end. The second arm extends downwardly and includes a free first end closer to the base portion and an opposite second end farther from the base portion. The second arm is configured to deflect when making electrical contact with a mating contact pin. The arcuate base portion connects the second ends of the first and second arms.

In at least one aspect, the present invention provides an electrical contact terminal including a base portion, an insulation displacement connecting portion extending upwardly from the base portion and comprising a pair of spaced apart arms defining an opening therebetween for receiving and making electrical contact with an electrical conductor, and a contact portion extending downwardly from the base portion and configured to float when the electrical contact terminal is retained and positioned within a connector housing. The contact portion includes a first arm and a second arm. The first arm extends forwardly at a first end of the contact portion attached to the base portion. The second arm extends forwardly at an opposite second end of the contact portion. The first and second arms are configured to deflect when making electrical contact with a mating contact pin.

The above summary of the present invention is not intended to describe each disclosed embodiment or every implementation of the present invention. The details of one or more embodiments of the present invention are set forth in the accompanying drawings and the detailed description below. Other features, objects, and advantages of the invention will be apparent from the detailed description and drawings, and from the claims.

DETAILED DESCRIPTION

Figure 1:
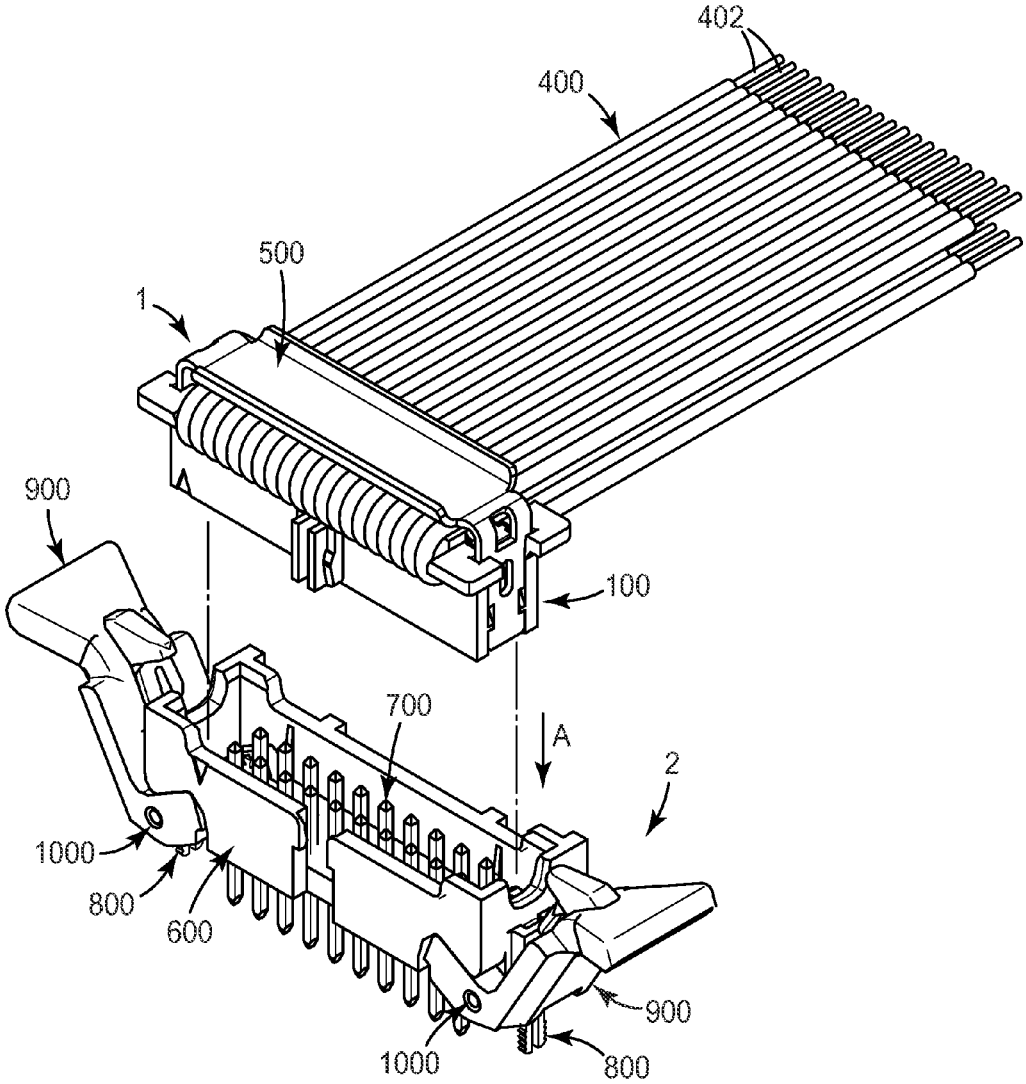
FIG. 1 is a perspective view of an exemplary embodiment of an electrical connector system according to an aspect of the present invention in an unmated configuration.

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

In the illustrated embodiments, directional representations, i.e., up, down, left, right, front, rear and the like, used for explaining the structure and movement of the various elements of the present application, are relative. These representations are appropriate when the elements are in the position shown in the Figures. If the description of the position of the elements changes, however, it is assumed that these representations are to be changed accordingly. Throughout the Figures, like reference numbers denote like parts.

Exemplary embodiments of an electrical connector system according to aspects of the present invention have numerous advantages over conventional connector systems. Advantages include 1) a connector housing of a mating electrical connector (which may in some embodiments be referred to as "socket" or "wire mount electrical connector") which includes guiding, positioning, and securing elements to enable assembly of a cover and a strain relief in a reduced space, 2) an electrical contact terminal which provides an increased spring beam length, a reduced localized stress, and an increased spring force for a given overall contact height enabling a lower overall connector height, 3) a cover which includes guiding, positioning, and securing elements to enable assembly to a connector housing of a mating electrical connector while occupying a minimized space of the connector, 4) a strain relief which includes guiding, positioning, and securing elements to enable assembly to a connector housing of a mating electrical connector while occupying a minimized space of the connector, 5) a connector housing of an electrical connector (which may in some embodiments be referred to as "header" or "board mount electrical connector") which enables blind mating of a mating electrical connector and has a significantly reduced overall connector size relative to the contact pitch, and 6) a latch which can both securely latch a mating electrical connector to a connector housing of an electrical connector and eject the mating electrical connector from the connector housing with or without the presence of a strain relief, and which is integrated with the connector housing such as to minimize the overall connector size relative to the contact pitch, to name a few. Further advantages will be described herein throughout.

Principles and elements of the exemplary embodiments of an electrical connector system described herein and variations thereof allow electrical connector systems to be made smaller, more reliable, and at a lower cost. These principles and elements may be applied to any suitable electrical connector system, such as, e.g., 2.0 mm, 0.050" (1.27 mm), 1.0 mm, 0.8 mm, and 0.5 mm pitch wire-to-board sockets and headers, to name a few.

Figure 2:
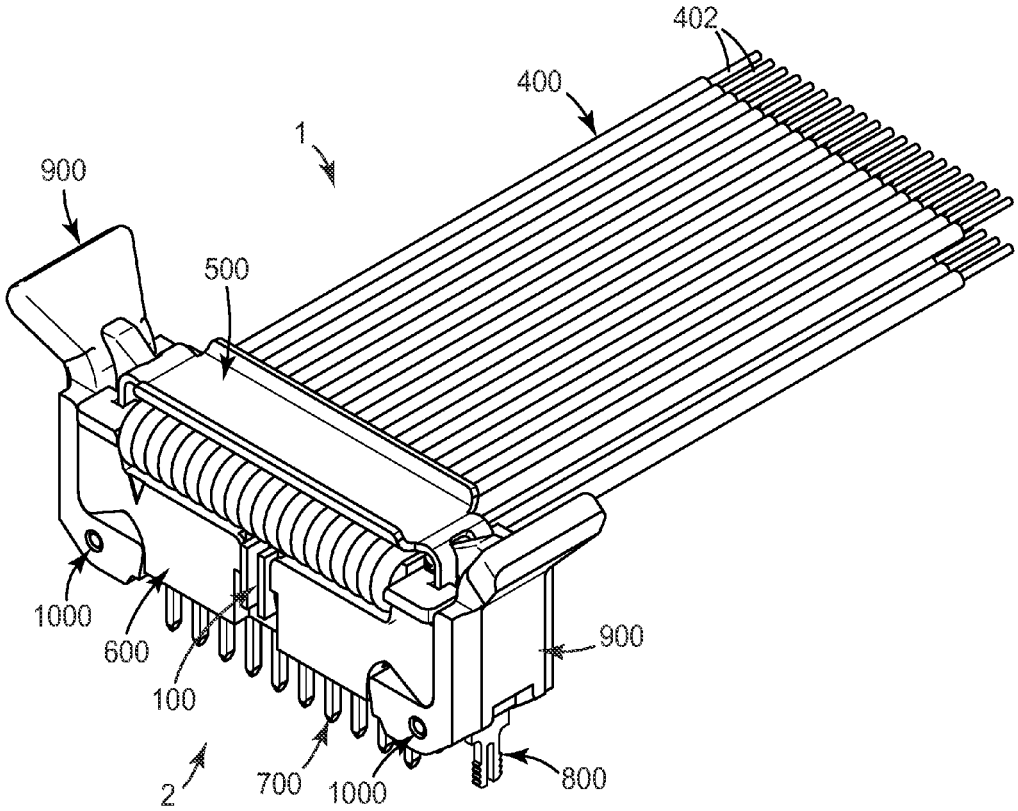
FIG. 2 is a perspective view of an exemplary embodiment of an electrical connector system according to an aspect of the present invention in a mated configuration.
Figure 3:
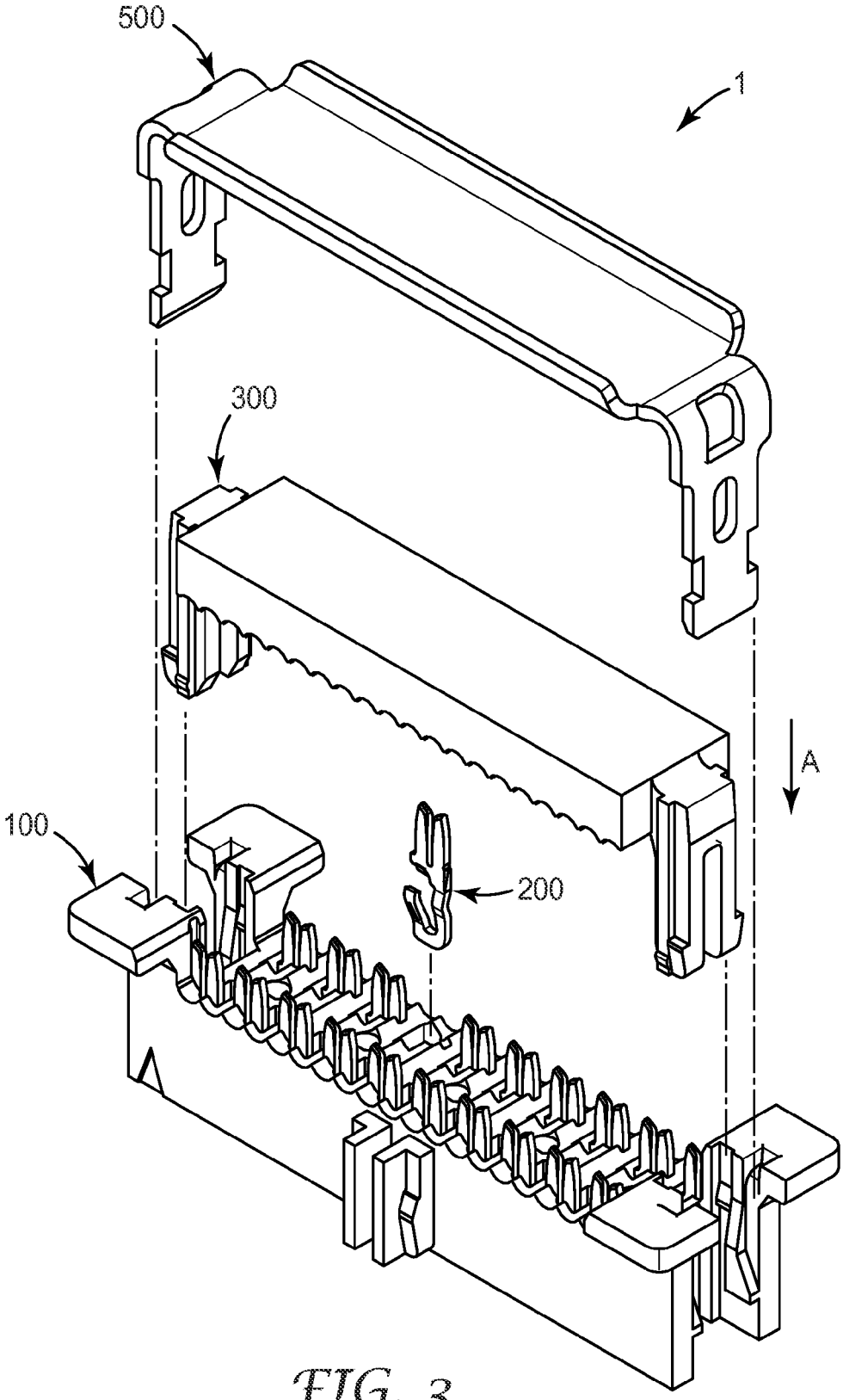
FIG. 3 is an exploded perspective view of an exemplary embodiment of a mating electrical connector according to an aspect of the present invention.

Referring now to the Figures, FIGS. 1-2 illustrate an exemplary embodiment of an electrical connector system according to an aspect of the present invention in an unmated configuration (FIG. 1) and in a mated configuration (FIG. 2). The electrical connector system includes a mating electrical connector 1 (which may in some embodiments be referred to as "socket" or "wire mount electrical connector") configured for mating with an electrical connector 2 (which may in some embodiments be referred to as "header" or "board mount electrical connector"). FIG. 3 illustrates an exemplary embodiment of a mating electrical connector according to an aspect of the present invention. Referring to FIG. 3, mating electrical connector 1 includes an insulative connector housing 100, a plurality of electrical contact terminals 200 supported in connector housing 100, and a cover 300 for attachment to connector housing 100. In at least one embodiment, mating electrical connector 1 further includes a strain relief 500 for attachment to connector housing 100.

Figure 4A:
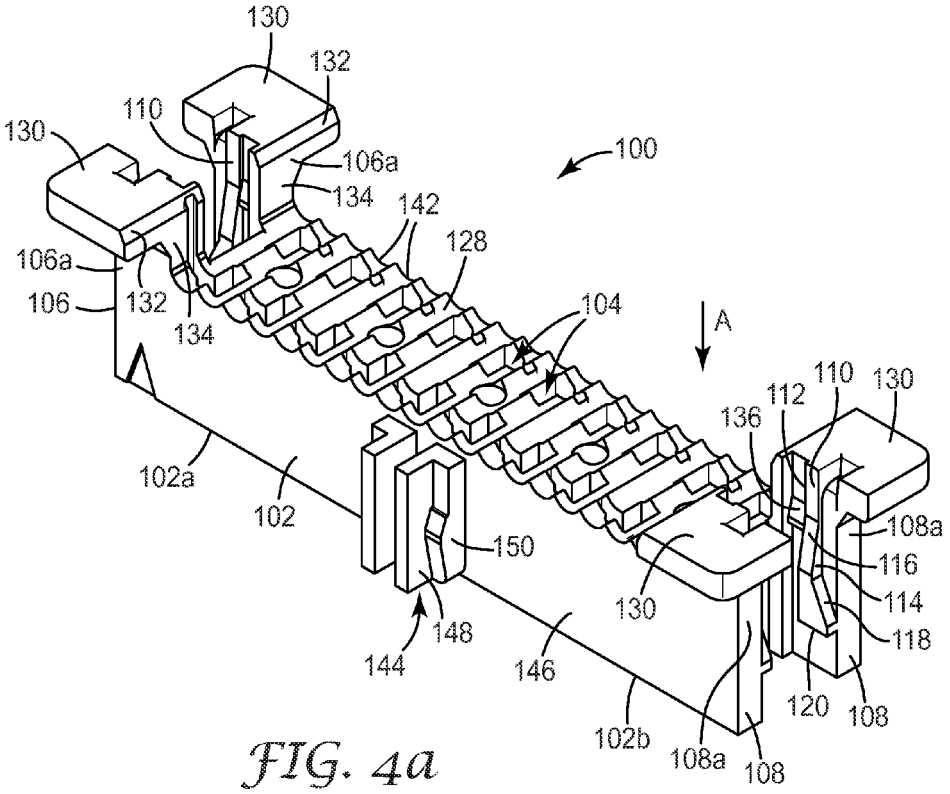
FIGS. 4*a*-4*e* are perspective, front, side, top, and bottom views, respectively, of an exemplary embodiment of a connector housing according to an aspect of the present invention.
Figure 4B:
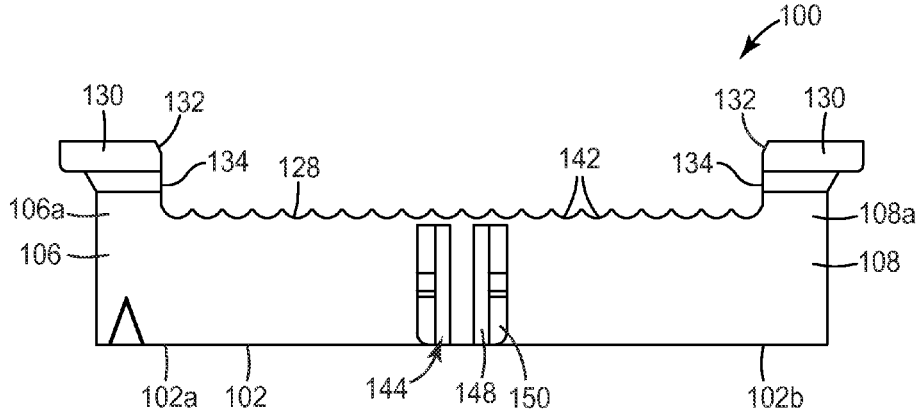
Figure 4C:
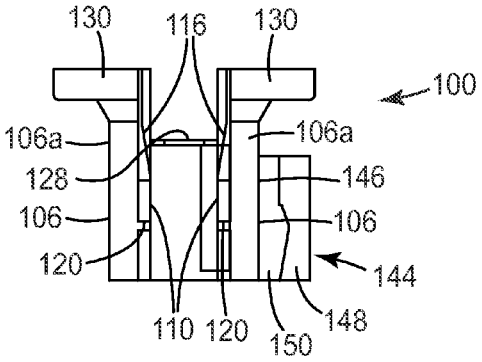
Figure 4D:
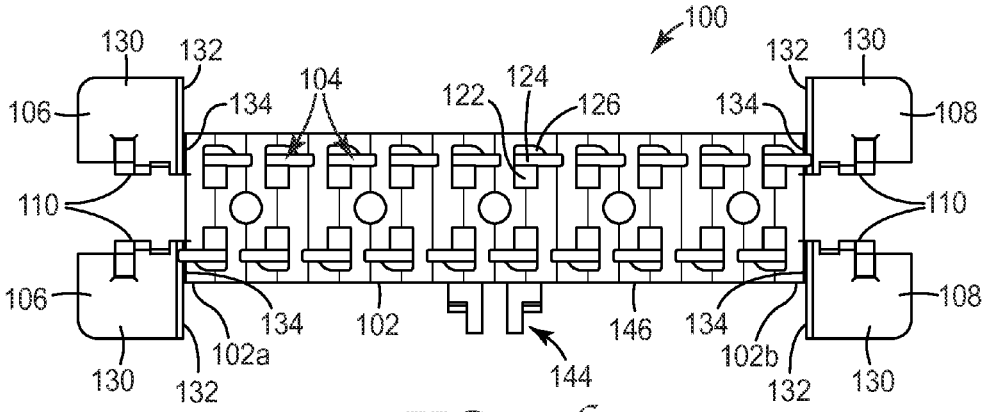
Figure 4E:
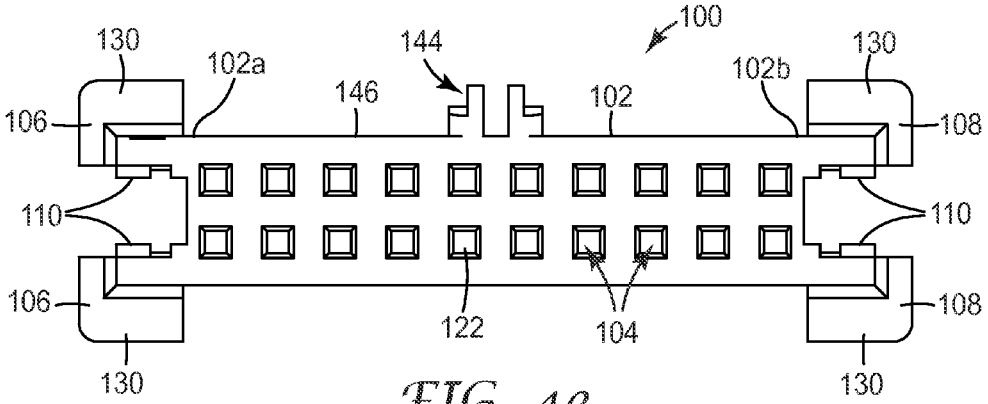
Figure 5A:
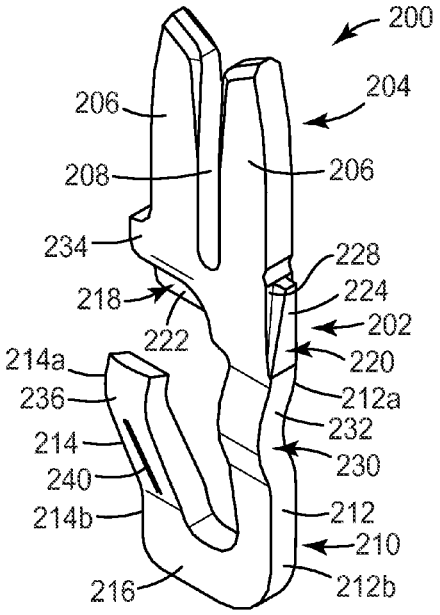
FIGS. 5*a*-5*c* are perspective, side, and front views, respectively, of an exemplary embodiment of an electrical contact terminal according to an aspect of the present invention.
Figure 5B:
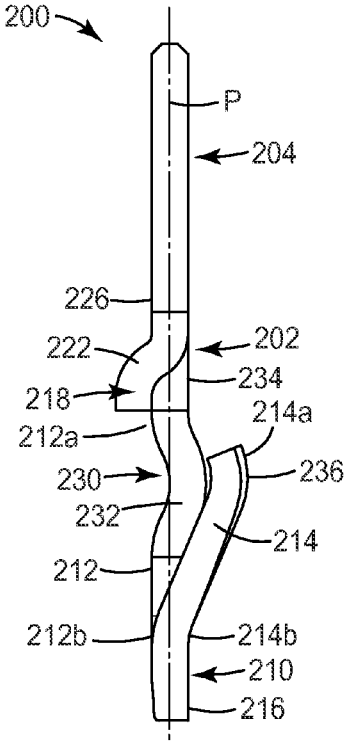
Figure 5C:
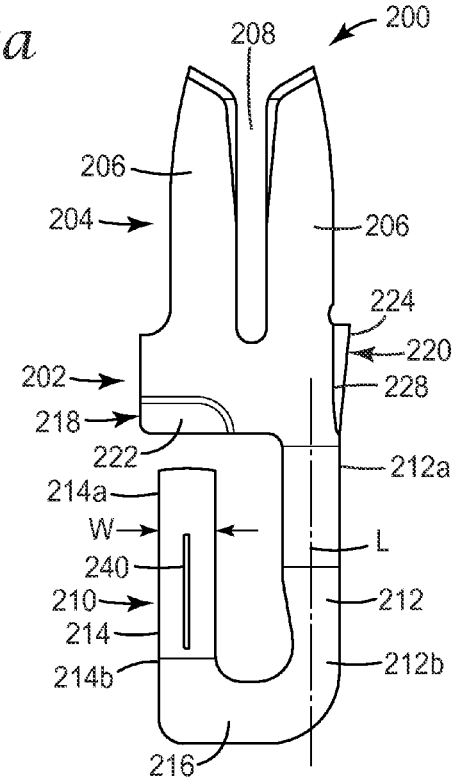
Figure 14:
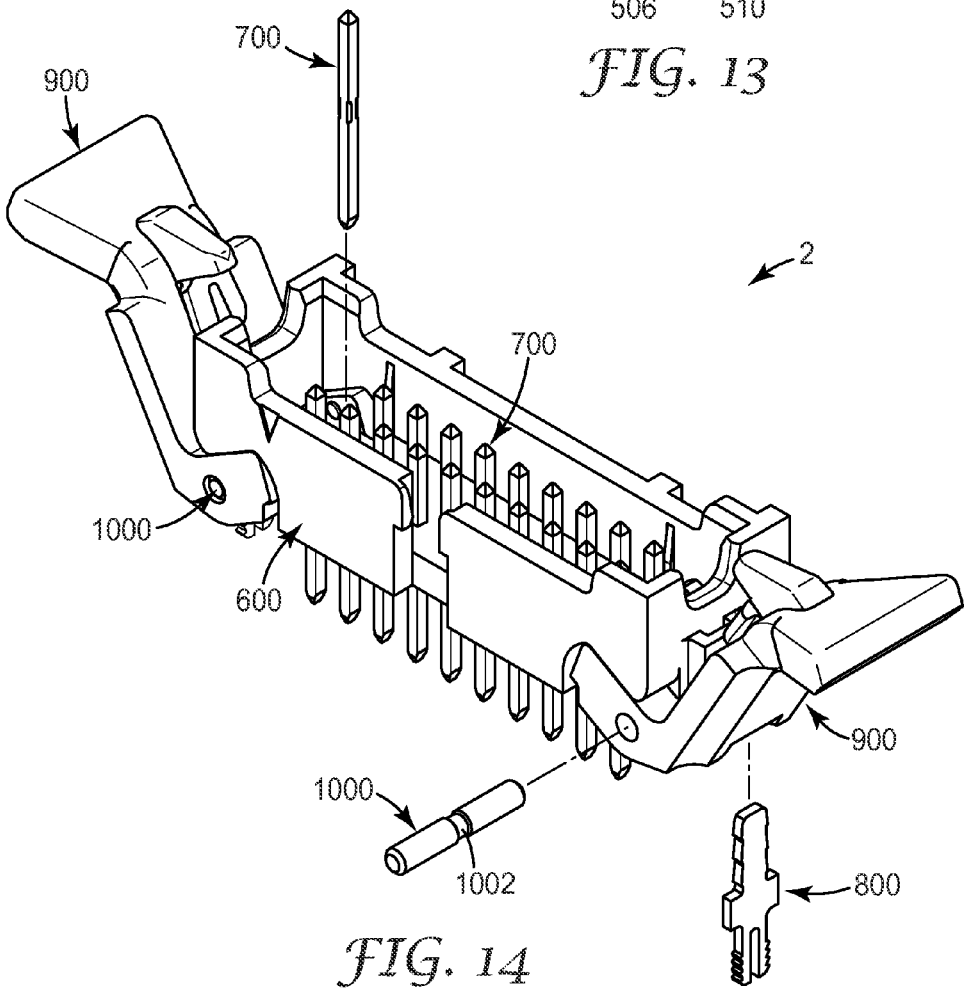
FIG. 14 is an exploded perspective view of an exemplary embodiment of an electrical connector according to an aspect of the present invention.

FIGS. 4*a*-4*e* illustrate an exemplary embodiment of a connector housing according to an aspect of the present invention. Referring to FIGS. 4*a*-4*e*, insulative connector housing 100 includes a longitudinal body portion 102 having a plurality of contact openings 104 extending therein in an insertion direction A. Contact openings 104 are configured to support a plurality of electrical contact terminals, such as, e.g., electrical contact terminals 200 (FIGS. 5*a*-5*c*). In at least one embodiment, each contact opening 104 includes a contact pin receiving portion 122 extending through body portion 102 and a contact retention portion 124 adjacent to contact pin receiving portion 122. Contact pin receiving portion 122 is configured to receive an electrical contact pin of a mating connector, such as, e.g., electrical contact pin 700 of electrical connector 2 (FIG. 14). Contact retention portion 124 is configured to retain an electrical contact terminal In at least one embodiment, contact retention portion 124 includes a shelf portion 126 configured to retain an electrical contact terminal Shelf portion 126 is configured to prevent downward movement of an electrical contact terminal, e.g., during termination of an electrical conductor to the electrical contact terminal. The design and location of contact retention portion 124 minimizes the space used for contact retention, thereby enabling a minimized connector design.

Insulative connector housing 100 further includes first and second pairs of opposing end portions 106, 108 extending from opposing ends 102*a*, 102*b* of body portion 102 in insertion direction A. End portions 106, 108 are configured to effectively guide, position, and retain a cover (see, e.g., FIG. 3 and FIGS. 10*a*-10*c*) and a strain relief (see, e.g., FIG. 3 and FIG. 13) while occupying a minimized space, thereby enabling a minimized connector design. In at least one embodiment, end portions 106, 108 extend beyond a top surface 128 of body portion 102. Extending end portions 106, 108 beyond top surface 128 facilitate alignment of a cover and a strain relief. It also facilitates alignment of a connector housing of a mating connector before electrical contact pins of the mating connector engage connector housing 100, allowing for blind mating of the mating connector with little risk of damaging electrical contact pins during mating.

In at least one embodiment, end portions 106, 108 each include a flange 130 extending laterally therefrom at an end 106*a*, 108*a* thereof. Flanges 130 facilitate connector housing 100 to be easily handled, e.g., during mating and unmating. For example, to enable easy removal of mating electrical connector 1 from an electrical connector, flanges 130 may be grabbed between a human finger and thumb. In at least one embodiment, flanges 130 include conductor insertion guide surfaces 132 configured to accommodate engagement of an electrical conductor, such as, e.g., a discrete electrical conductor or an electrical conductor as part of an electrical cable, such as, e.g., electrical conductors 402 of electrical cable 400 (FIG. 1). Conductor insertion guide surfaces 132 are configured to guide an electrical conductor in a width direction (along the length of connector housing 100) reducing misaligned conductor terminations and increasing conductor termination rate.

In at least one embodiment, end portions 106, 108 include opposing conductor support surfaces 134 configured to support an electrical conductor. In at least one aspect, conductor support surfaces 134 are configured to securely support outside conductors of a ribbon cable to eliminate high resistance failures on the outside conductors common to conventional ribbon cable connectors.

Figure 10A:
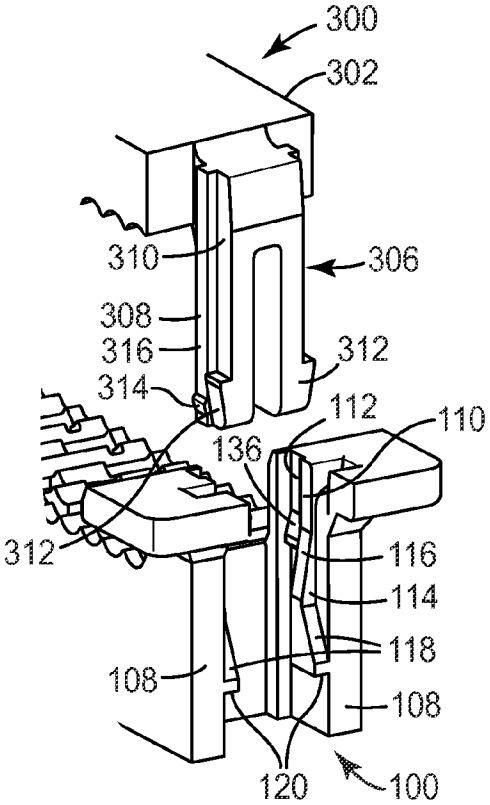
FIGS. 10*a*-10*c* are partial perspective views of an exemplary embodiment of a cover and a connector housing according to an aspect of the present invention aligned for assembly, in an open position, and in a closed position, respectively.
Figure 10B:
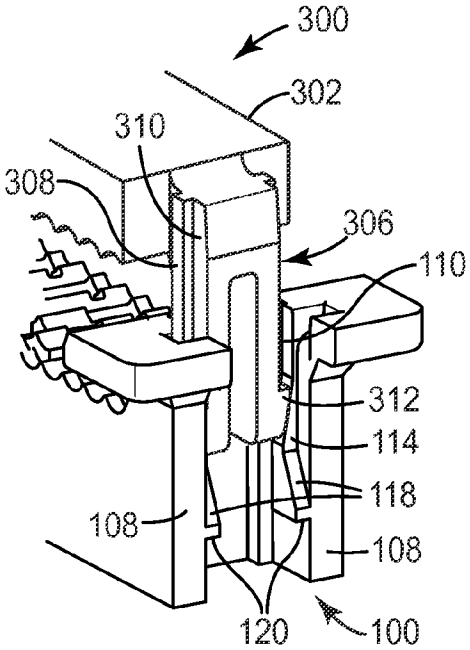
Figure 10C:
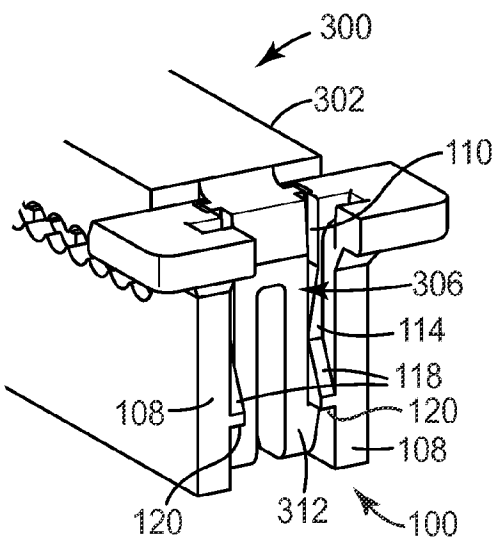
Figure 13:
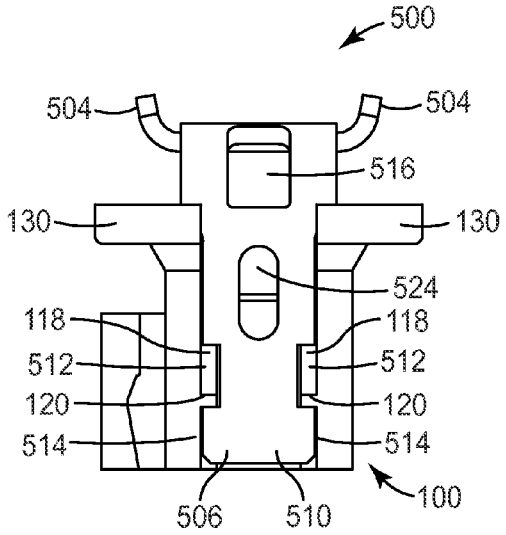
FIG. 13 is a side view of an exemplary embodiment of a strain relief and a connector housing according to an aspect of the present invention in an assembled configuration.

At least one end portion in each pair of opposing end portions 106, 108 includes a ridge 110 extending in insertion direction A. Ridge 110 is configured to guide a cover latch, such as, e.g., first and second cover latches 304, 306 of cover 300 (FIGS. 9*a*-9*e*), along a side surface 112 of ridge 110 and a strain relief latch, such as, e.g., first and second strain relief latches 506 of strain relief 500 (FIGS. 11*a*-11*b*), along an opposing side surface 114 of ridge 110. As best illustrated in FIG. 4*a*, ridge 110 has an inclined top surface 116 for resiliently deflecting a cover latch and an inclined side surface 118 for resiliently deflecting a strain relief latch. In at least one embodiment, inclined top surface 116 is configured to accommodate positioning of a cover in an open position. Ridge 110 further has an end portion 120 for latching onto a cover latch and a strain relief latch. In at least one embodiment, end portion 120 is configured to accommodate retention of a cover in a closed position, e.g., as illustrated in FIG. 10*c*. In at least one embodiment, end portion 120 is configured to accommodate retention of a strain relief, e.g., as illustrated in FIG. 13.

In at least one embodiment, at least one end portion in each pair of opposing end portions 106, 108 includes a catch portion 136 for resiliently deflecting and latching onto a cover latch. In at least one embodiment, catch portion 136 is configured to accommodate retention of a cover in an open position, e.g., as illustrated in FIG. 10*b*.

In at least one embodiment, body portion 102 further includes a plurality of conductor grooves 142 extending in a transverse direction perpendicular to insertion direction A in a top surface 128 thereof. Conductor grooves 142 are configured to accommodate electrical conductors. In at least one embodiment, conductor grooves 142 have a cross-sectional shape substantially corresponding to the cross-sectional shape of the electrical conductors.

In at least one embodiment, body portion 102 further includes a polarization element 144 disposed on a side 146 thereof. Polarizing element 144 is configured to engage with a polarization opening of a mating connector, such as, e.g., polarization opening 628 of connector housing 600 (FIGS. 16*a*-16*e*). Polarization element 144 includes a taller ridge 148 extending in insertion direction A. Taller ridge 148 is configured to be disposed within the polarization opening. In combination, polarization element 144 and the polarization opening prevent mating electrical connector 1 from being incorrectly, i.e., rotated 180° about insertion direction A, mated to the mating connector. In at least one embodiment, polarization element 144 further includes a shorter ridge 150 extending in insertion direction A. Shorter ridge 150 is configured to frictionally engage a surface of the mating connector, such as, e.g., interior surface 652 of connector housing 600 (FIGS. 16*a*-16*e*). In at least one aspect, this allows mating electrical connector 1 to be securely attached to the mating connector, which is particularly useful in the absence of a separate latch/eject mechanism. Polarization element 144 may be on either side of body portion 102 at any suitable location.

In at least one embodiment, electrical connector 1 further includes a plurality of electrical contact terminals supported in contact openings 104. FIGS. 5*a*-5*c* illustrate an exemplary embodiment of an electrical contact terminal according to an aspect of the present invention. Referring to FIGS. 5*a*-5*c*, electrical contact terminal 200 includes a base portion 202, an insulation displacement connecting (IDC) portion 204, and a contact portion 210. Base portion 202 is configured for positioning and retaining electrical contact terminal 200 within a connector housing, such as, e.g., connector housing 100. IDC portion 204 extends upwardly from base portion 202 and includes a pair of spaced apart arms 206 defining an opening 208 therebetween for receiving and making electrical contact with an electrical conductor. Contact portion 210 extends downwardly from base portion 202 and is configured to float when electrical contact terminal 200 is retained and positioned within a connector housing. The design and floating configuration of contact portion 210 provides an increased spring beam length, a reduced localized stress, and an increased spring force for a given overall contact height enabling a lower overall connector height. For example, in at least one embodiment, body portion 102 has a height that is less than about 3 mm.

Contact portion 210 includes a first arm 212, a second arm 214, and an arcuate base portion 216. First arm 212 extends downwardly and includes a first end (212*a*) attached to base portion 202 and an opposite second end 212*b*. Second arm 214 extends downwardly and includes a free first end 214*a* closer to base portion 202 and an opposite second end 214*b* farther from base portion 202. Second arm 214 is configured to deflect when making electrical contact with a mating contact pin, such as, e.g., electrical contact pin 700 of electrical connector 2 (FIG. 14). Arcuate base portion 216 connects second end 212*b* of first arm 212 and second end

Figure 8A:
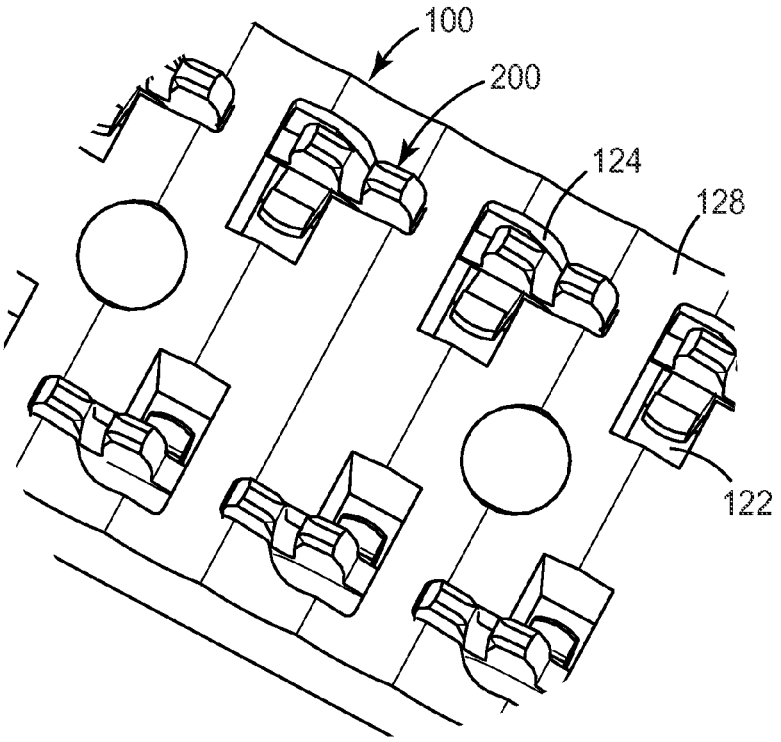
FIGS. 8*a*-8*b* are perspective and cross-sectional views, respectively, of an exemplary embodiment of a plurality of electrical contact terminals assembled in a connector housing according to an aspect of the present invention.

214*b* of second arm 214. In at least one embodiment, at least one of first arm 212 and arcuate base portion 216 is configured to deflect when second arm 214 makes electrical contact with a mating contact pin. This configuration of at least one of first arm 212 and arcuate base portion 216 adds to the effective length of the contact spring beam. In at least one embodiment, the deflection includes a rotation about a longitudinal axis L of first arm 212. In at least one embodiment, a width W of second arm 214 tapers from second end 214*b* of second arm 214 to free first end 214*a* of second arm 214. This tapered configuration of second arm 214 assists in the ability of contact portion 210 to withstand a desired normal force without yielding. In at least one embodiment, contact portion 210 can withstand a normal force of about 250 grams without yielding. In at least one embodiment, first arm 212 and second arm 214 do not lie in a same plane. In at least one embodiment, when second arm 214 deflects when making contact with a mating contact pin, the deflection creates a stress distribution that extends to first arm 212. In at least one embodiment, the stress distribution ranges from about 0 psi to about 165K psi. In at least one embodiment, the stress distribution ranges from about 25K psi to about 165K psi. In at least one embodiment, contact portion 210 is J-shaped. In at least one embodiment, contact portion 210 is U-shaped. In at least one embodiment, second arm 214 includes a curvilinear contacting portion 236 positioned at free first end 214*a* of second arm 214. In the illustrated embodiment, curvilinear contacting portion 236 is defined by a curved end of second arm 214. Alternatively, curvilinear contacting portion 236 may take alternate forms from the one illustrated, and may include, e.g., a Hertzian bump extending from second arm 214. In at least one embodiment, such as, e.g., the embodiment illustrated in FIGS. 5*a*-5*c*, contacting portion 236 faces away from base portion 202. In at least one embodiment, second arm 214 includes a rib 240 configured to increase the stiffness of second arm 214. In at least one embodiment, second arm 214 is configured to deflect toward a major plane P of base portion 202 when it makes electrical contact with a mating contact pin. In at least one aspect, when electrical contact terminal 200 is assembled in contact opening 104 of connector housing 100, second arm 214 is disposed in contact pin receiving portion 122 of contact opening 104, as best illustrated in FIG. 8*a*. As such, second arm 214 deflects when making electrical contact with a mating contact pin received by contact pin receiving portion 122.

In at least one embodiment, electrical contact terminals 200 each include at least one retaining portion to retain electrical contact terminals 200 in contact openings 104 of connector housing 100. The retaining portion may be configured to prevent electrical contact terminal 200 from moving in insertion direction A, e.g., during termination of an electrical conductor to the electrical contact terminal The retaining portion may be configured to prevent electrical contact terminal 200 from moving a direction lateral to insertion direction A, e.g., to prevent interference of at least a portion of contact portion 210 with side walls of contact opening 104.

Figure 8B:
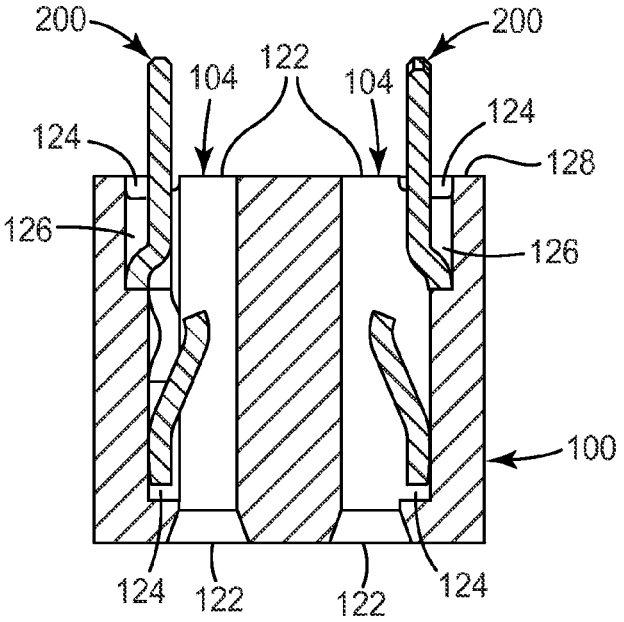
Figure 9A:
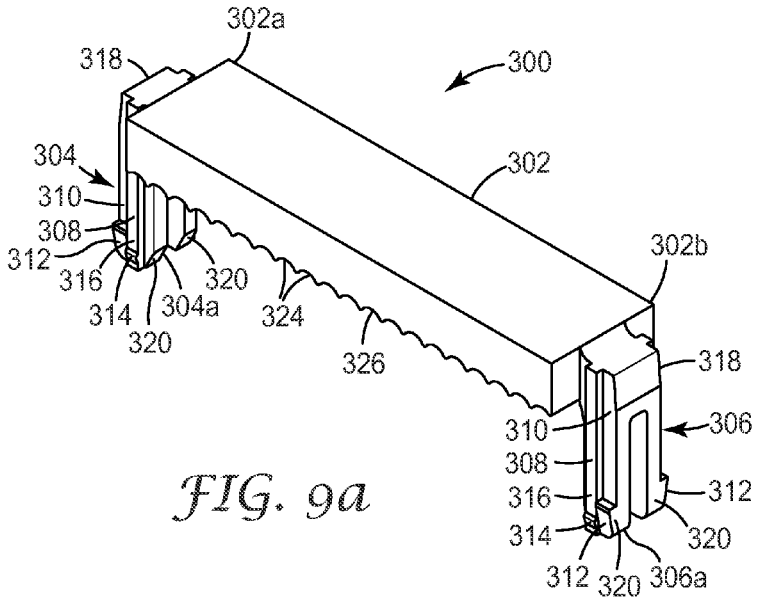
FIGS. 9*a*-9*e* are perspective, front, side, top, and bottom views, respectively, of an exemplary embodiment of a cover according to an aspect of the present invention.
Figure 9B:
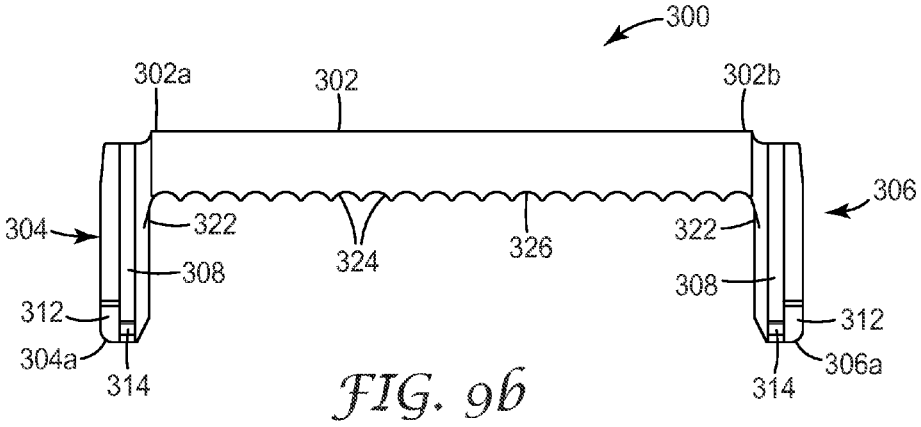
Figure 9C:
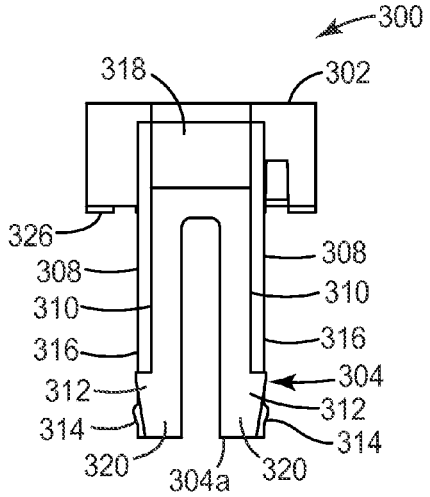
Figure 9D:
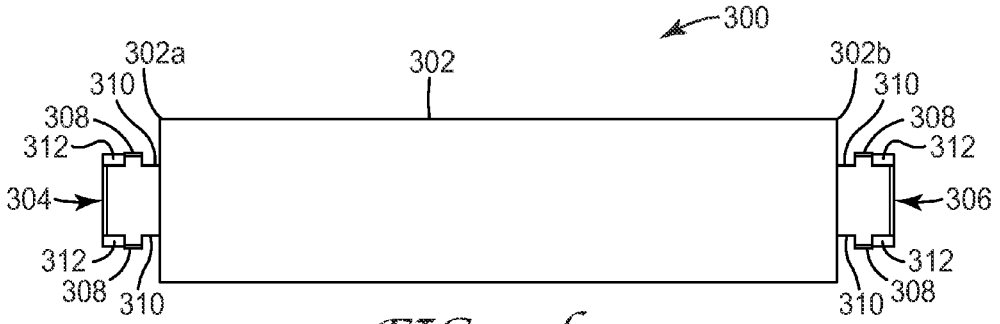
Figure 9E:
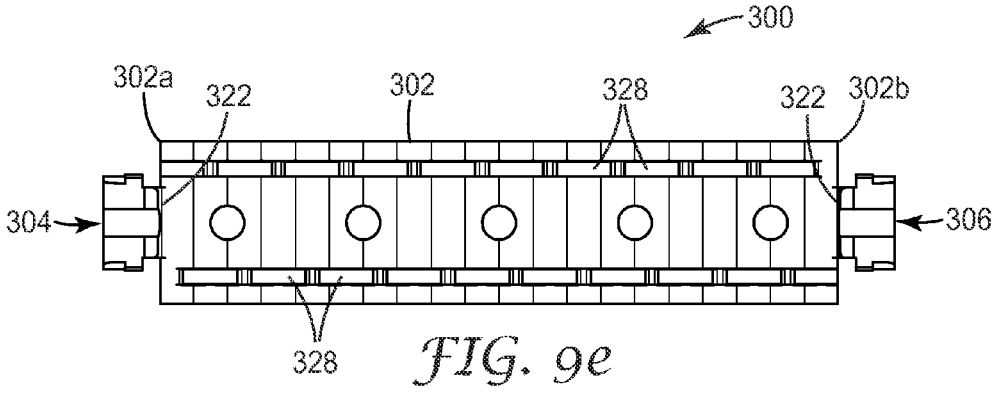

In at least one embodiment, base portion 202 includes a first retaining portion 218 configured to retain and position electrical contact terminal 200 in a connector housing. In at least one embodiment, first retaining portion 218 is configured to prevent downward movement of electrical contact terminal 200 during termination of an electrical conductor. In at least one embodiment, first retaining portion 218 includes a shell-shaped portion 222. In at least one aspect, when electrical contact terminal 200 is assembled in contact opening 104 of connector housing 100, shell-shaped portion 222 is disposed on shelf portion 126 of contact opening 104, as best illustrated in FIG. 8*b*. As such, in combination, shell-shaped portion 222 and shelf portion 126 prevent electrical contact terminal 200 from moving in insertion direction A, e.g., during termination of an electrical conductor to the electrical contact terminal In at least one embodiment, first retaining portion 218 extends from a first major surface 226 of electrical contact terminal 200 and is configured to retain and longitudinally position electrical contact terminal 200 in a connector housing.

In at least one embodiment, base portion 202 includes a second retaining portion 220 configured to retain and position electrical contact terminal 200 in a connector housing. In at least one embodiment, second retaining portion 220 extends from a side surface 228 of base portion 202 and is configured to retain and laterally position electrical contact terminal 200 in a connector housing. In at least one embodiment, second retaining portion 220 includes a wedge-shaped portion 224. In at least one aspect, when electrical contact terminal 200 is assembled in contact opening 104 of connector housing 100, wedge-shaped portion 224 is disposed in and provides an interference fit or press-fit with contact retention portion 124 of contact opening 104. As such, in combination, wedge-shaped portion 224 and retention portion 124 retain and laterally position electrical contact terminal 200 in connector housing 100.

In at least one embodiment, first arm 212 includes a third retaining portion 230 configured to retain and position electrical contact terminal 200 in a connector housing. In at least one embodiment, third retaining portion 230 extends from a second major surface 234 of electrical contact terminal 200 and is configured to retain and laterally position electrical contact terminal 200 in a connector housing. In at least one embodiment, third retaining portion 230 includes a curved portion 232. In at least one aspect, when electrical contact terminal 200 is assembled in contact opening 104 of connector housing 100, curved portion 232 is disposed in and provides an interference fit or press-fit with contact retention portion 124 of contact opening 104, as best illustrated in FIG. 8*b*. As such, in combination, curved portion 232 and retention portion 124 retain and laterally position electrical contact terminal 200 in connector housing 100.

Figure 6A:
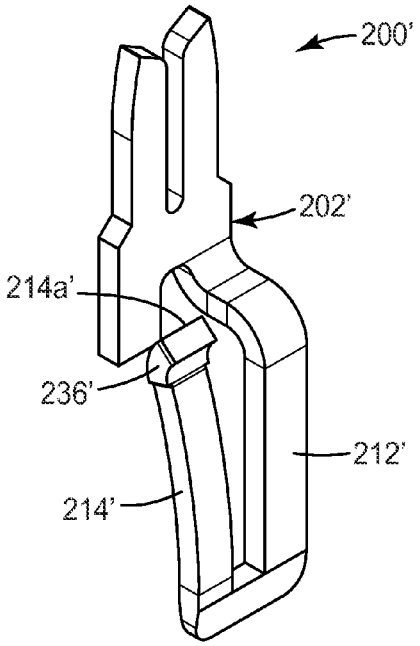
FIGS. 6*a*-6*c* are perspective, side, and front views, respectively, of another exemplary embodiment of an electrical contact terminal according to an aspect of the present invention.
Figure 6B:
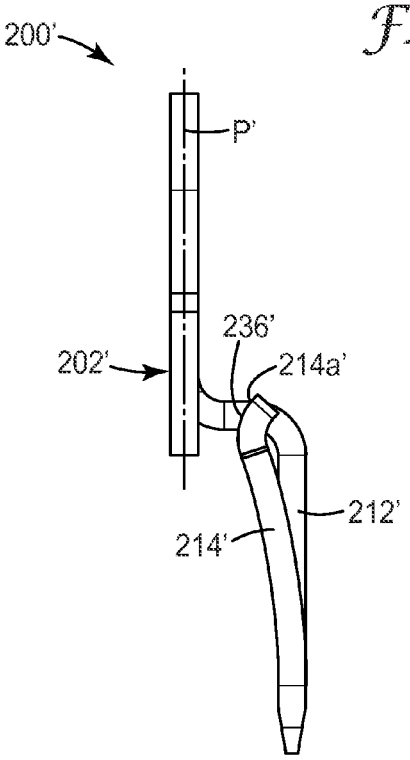
Figure 6C:
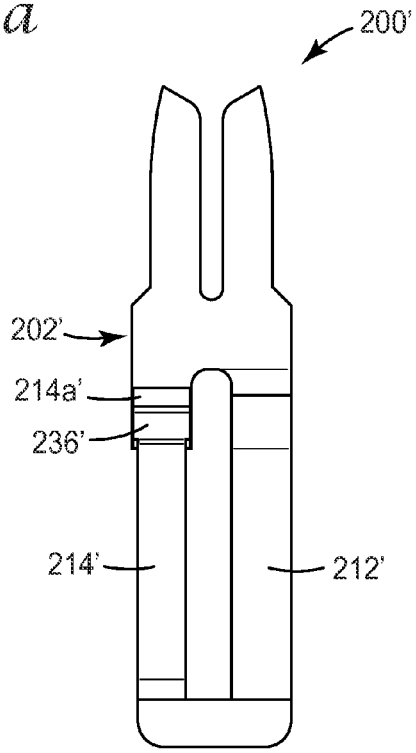

FIGS. 6*a*-6*c* illustrate another exemplary embodiment of an electrical contact terminal according to an aspect of the present invention. Referring to FIGS. 6*a*-6*c*, electrical contact terminal 200' is similar to electrical contact terminal 200. In FIGS. 6*a*-6*c*, elements of electrical contact terminal 200' that are similar to those of electrical contact terminal 200 have the same numbers but provided with a prime (') to indicate their association with electrical contact terminal 200'. In electrical contact terminal 200', first arm 212' and base portion 202' do not lie in a same plane. In at least one embodiment, second arm 214' includes a curvilinear contacting portion 236' positioned at free first end 214*a*' of second arm 214'. In at least one embodiment, contacting portion 236' faces toward base portion 202'. In at least one aspect, an electrical contact pin of a mating connector is positioned between base portion 202' and second arm 214' when electrical connector 1 and the mating connector are in a mated configuration. In at least one embodiment, second arm 214' is configured to deflect away from a major plane P' of base portion 202 when it makes electrical contact with a mating contact pin. In at least one aspect, this electrical contact terminal configuration requires less space on the outer wall of body portion 102 of connector housing 100.

Figure 7A:
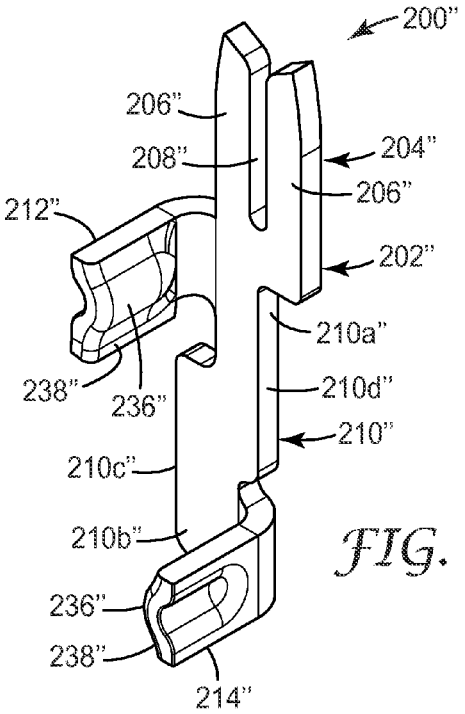
FIGS. 7*a*-7*c* are perspective, side, and front views, respectively, of another exemplary embodiment of an electrical contact terminal according to an aspect of the present invention.
Figure 7B:
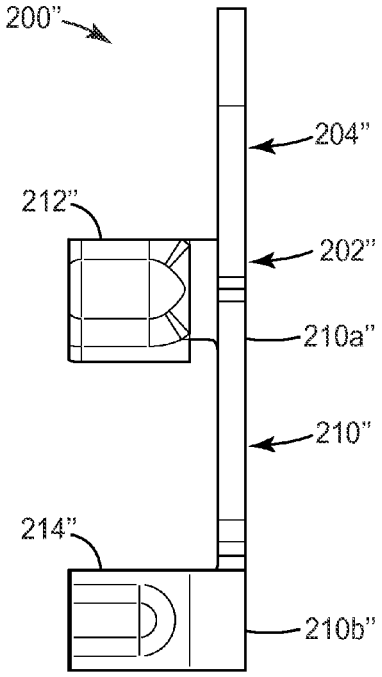
Figure 7C:
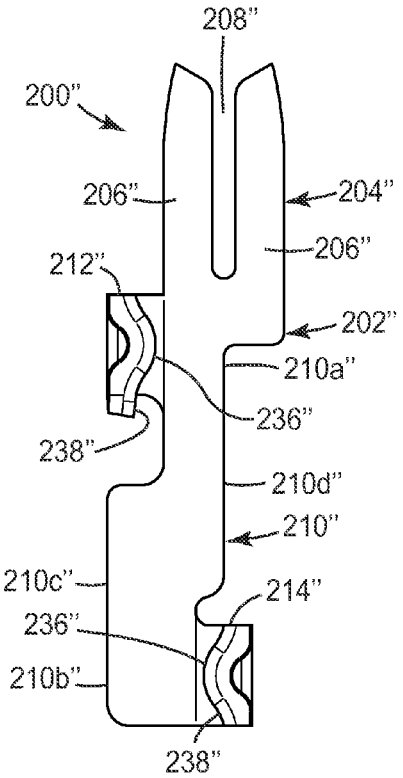

FIGS. 7*a*-7*c* illustrate another exemplary embodiment of an electrical contact terminal according to an aspect of the present invention. Referring to FIGS. 7*a*-7*c*, electrical contact terminal 200" is similar to electrical contact terminal 200. In FIGS. 7*a*-7*c*, elements of electrical contact terminal 200" that are similar to those of electrical contact terminal 200 have the same numbers but provided with a double prime (") to indicate their association with electrical contact terminal 200". Electrical contact terminal includes a base portion 202", an IDC portion 204", and a contact portion 210". IDC portion 204" extends upwardly from base portion 202" and includes a pair of spaced apart arms 206" defining an opening 208" therebetween for receiving and making electrical contact with an electrical conductor. Contact portion 210" extends downwardly from base portion 202" and is configured to float when electrical contact terminal 200" is retained and positioned within a connector housing. Contact portion 210" includes a first arm 212" and a second arm 214". First arm 212" extends forwardly at a first end 210*a*" of contact portion 210" attached to base portion 202". Second arm 214" extends forwardly at an opposite second end 210*b*" of contact portion 210". First and second arms 212", 214" are configured to deflect when making electrical contact with a mating contact pin. In at least one embodiment, first and second arms 212", 214" extend at opposing sides 210*c*", 210*d*" of contact portion 210". In at least one embodiment, first and second arms 212", 214" each include a curvilinear contacting portion 236" extending from a major surface 238" thereof. In the illustrated embodiment, curvilinear contacting portion 236" is defined by a curved end of first and second arms 212", 214". Alternatively, curvilinear contacting portion 236" may take alternate forms from the one illustrated, and may include, e.g., a Hertzian bump extending from first and second arms 212", 214". In at least one embodiment, contacting portions 236" extend from first and second arms 212", 214" toward each other. In at least one aspect, an electrical contact pin of a mating connector is positioned between base portion first and second arms 212", 214" when electrical connector 1 and the mating connector are in a mated configuration. In at least one aspect, first and second arms 212", 214" define short side wiping spring beams.

In at least one embodiment, electrical connector 1 further includes a cover for reliably terminating at least one electrical conductor, e.g., electrical conductors 402 of electrical cable 400 (FIG. 1), to a corresponding electrical contact terminal supported in a connector housing. The cover is configured to provide protection of the termination when securely attached to the connector housing. FIGS. 9*a*-9*e* illustrate an exemplary embodiment of a cover according to an aspect of the present invention, and FIGS. 10*a*-10*c* illustrate an exemplary embodiment of a cover and a connector housing according to an aspect of the present invention aligned for assembly, in an open position, and in a closed position, respectively.

Referring to FIGS. 9*a*-9*e*, cover 300 for an electrical connector includes a longitudinal body portion 302 extending along a first direction and first and second cover latches 304, 306 extending from opposing longitudinal ends 302*a*, 302*b* thereof in a second direction different than the first direction. In at least one aspect, when cover 300 is used with electrical connector housing 100, the second direction is equal to insertion direction A. Each cover latch 304, 306 includes at least one ridge 308 and at least one first catch portion 312. Ridge 308 is disposed on a side surface 310 of cover latch 304, 306 and extends in the second direction for guiding cover latch 304, 306 along a ridge of a connector housing, such as, e.g., ridge 110 of connector housing 100. First catch portion 312 is disposed on side surface 310 at an end 304*a*, 306*a* of cover latch 304, 306 distant from body portion 302 for being deflected by and engaging the ridge of the connector housing to secure cover 300 with respect to the connector housing.

In at least one embodiment, the ridge of the connector housing includes an inclined top surface, such as, e.g., inclined top surface 116 of ridge 110, for resiliently deflecting cover latch 304, 306. When first catch portion 312 engages the inclined top surface, cover 300 is positioned in an open position, e.g., as illustrated in FIG. 10*b*. When cover latch 304, 306 is resiliently deflected by the inclined top surface, the spring force generated by cover latch 304, 306 keeps cover 300 in the open position, preventing cover 300 from unintentionally closing and resisting unintentional cover termination until adequate force is applied. In the open position, cover 300 is prepositioned with respect to the connector housing to allow an electrical conductor or cable to be easily inserted between cover 300 and the connector housing for termination. In at least one aspect, the prepositioning of cover 300 provides a space of about three times the diameter of a typical electrical conductor or cable that can be used with electrical connector 1 to facilitate easy insertion of the conductor or cable, which increases the rate electrical conductors or cables can be terminated to electrical connectors 1. In at least one aspect, the prepositioning of cover 300 takes place in the lateral direction (as opposed to the longitudinal direction), which reduces the overall length of the connector housing and cover 300. For example, in at least one embodiment, body portion 102 has a length that is less than about 35 mm and includes at least 50 contact openings.

In at least one embodiment, the ridge of the connector housing includes an end portion, such as, e.g., end portion 120 of ridge 110, for latching onto cover latch 304, 306. When first catch portion 312 engages the end portion, cover 300 is retained in a closed position, e.g., as illustrated in FIG. 10*c*. In the closed position, cover 300 is securely attached to the connector housing and provides protection of the termination.

In at least one embodiment, ridge 308 includes a second catch portion 314 disposed on a top surface 316 thereof at an end 304*a*, 306*a* of cover latch 304, 306 distant from body portion 302. Second catch portion 314 is configured for being deflected by and engaging a catch portion of the connector housing, such as, e.g., catch portion 136 of connector housing 100, to secure cover latch 304, 306 with respect to the connector housing. In one embodiment, when second catch portion 314 engages the catch portion of the connector housing, cover 300 is retained in an open position, e.g., as illustrated in FIG. 10*b*. In one aspect, when second catch portion 314 engages the catch portion of the connector housing, cover 300 is prevented from unintentionally separating from the connector housing.

In at least one embodiment, each cover latch 304, 306 further includes a base portion 318 attached to body portion 302 and a pair of opposing latch arms 320 extending from base portion 318 in the second direction. In at least one aspect, when cover 300 is securely attached to a connector housing, latch arms 320 may be deflected toward each other, e.g., squeezed between a human finger and thumb, to release and remove cover 300 without damaging it.

In at least one embodiment, cover latches 304, 306 include opposing conductor support surfaces 322 configured to support an electrical conductor. In at least one aspect, conductor support surfaces 322 are configured to securely support outside conductors of a ribbon cable to eliminate high resistance failures on the outside conductors common to conventional ribbon cable connectors.

In at least one embodiment, body portion 302 further includes a plurality of conductor grooves 324 extending in a transverse direction perpendicular to the second direction in a bottom surface 326 thereof. Conductor grooves 324 are configured to accommodate electrical conductors. In at least one embodiment, conductor grooves 324 have a cross-sectional shape substantially corresponding to the cross-sectional shape of the electrical conductors. In at least one aspect, conductor grooves 324 of cover 300 and conductor grooves 142 of connector housing 100 cooperatively position, e.g., with respect to electrical contact terminals 200, and retain the electrical conductors.

In at least one embodiment, body portion 302 further includes a plurality of contact openings 328 extending therein in the second direction. Contact openings 328 are configured to receive portions of electrical contact terminals, such as, e.g., electrical contact terminals 200. In at least one aspect, each contact opening 328 provides clearance and lateral support for the IDC portion of a corresponding electrical contact terminal In at least one embodiment, electrical connector 1 further includes at least one electrical conductor, such as, e.g., a discrete electrical conductor or an electrical conductor as part of an electrical cable, such as, e.g., electrical conductors 402 of electrical cable 400 (FIG. 1). Referring to FIG. 1, electrical cable 400 includes a plurality of parallel spaced apart electrical conductors 402 surrounded by an insulation. Electrical cable 400 may be a conventional flat ribbon cable or any other suitable electrical cable. Electrical cable 400 may have any suitable number of electrical conductors 402 spaced at any suitable pitch. In one exemplary embodiment of electrical connector 1, electrical cable 400 includes 20 electrical conductors 402 spaced at a 0.025" (0.635 mm) pitch (FIG. 1), terminated to 2×10 electrical contact terminals 200 spaced at a 0.050"×0.050" (1.27 mm×1.27 mm) pitch (FIG. 3). Electrical conductors 402 may have any suitable wire configuration, such as, e.g., a 28 AWG solid wire or a 30 AWG solid or stranded wire, wherein the stranded wire may include, e.g., up to 19 wire strands. Electrical conductors may be surrounded by an insulation having any suitable diameter, such as, e.g., a diameter ranging from about 0.022" (0.559 mm) to about 0.028" (0.711 mm) for a 0.025" (0.635 mm) pitch cable.

Figure 11A:
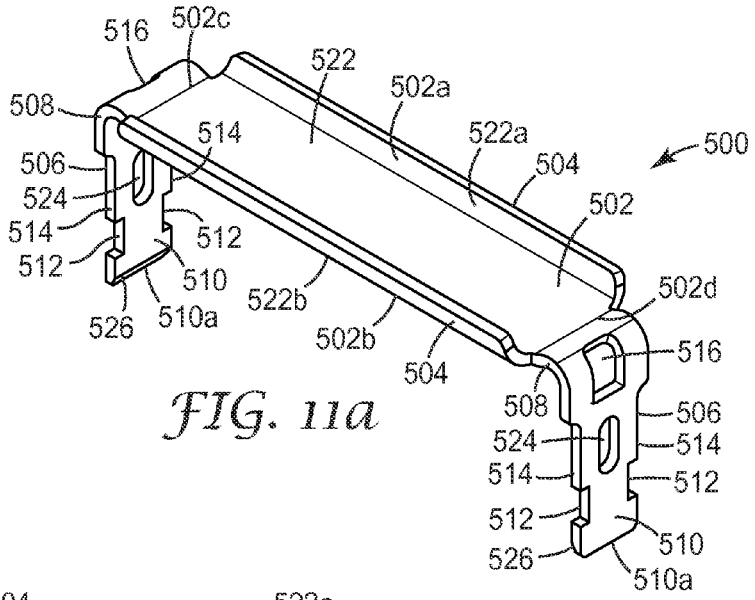
FIGS. 11*a*-11*b* are perspective and top views, respectively, of an exemplary embodiment of a strain relief according to an aspect of the present invention.
Figure 11B:
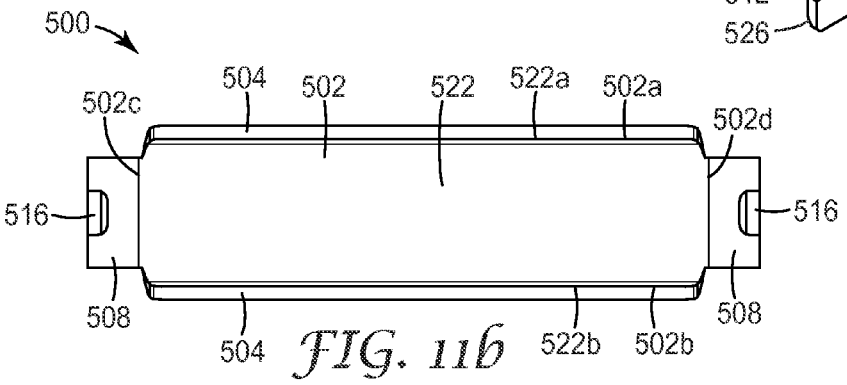

In at least one embodiment, electrical connector 1 further includes a strain relief for an electrical cable, such as, e.g., electrical cable 400. The strain relief is configured to securely retain a terminated electrical cable to prevent the termination from being compromised, e.g., during handling or movement of the electrical cable, when securely attached to the connector housing. In one aspect, the design of the strain relief requires a smaller overall electrical connector height and provides a strong and stable strain relief. FIGS. 11*a*-11*b* illustrate an exemplary embodiment of a strain relief according to an aspect of the present invention, and FIG. 13 illustrates a strain relief and a connector housing according to an aspect of the present invention in an assembled configuration.

Referring to FIGS. 11*a*-11*b*, strain relief 500 includes a longitudinal base portion 502 and first and second opposing strain relief latches 506 extending from opposing lateral sides 502*c*, 502*d* of base portion 502. In at least one aspect, when strain relief 500 is used with electrical connector housing 100, first and second strain relief latches 506 extend from opposing lateral sides 502*c*, 502*d* generally in insertion direction A. Longitudinal base portion 502 includes curved side portions 504 extending upwardly from opposing longitudinal sides 502*a*, 502*b* thereof. In at least one aspect, curved side portions 504 add rigidity to strain relief 500 while allowing strain relief 500 to still have a lower profile (smaller thickness) than many conventional strain reliefs. In the embodiment illustrated in FIGS. 11*a*-11*b*, base portion 502 includes a longitudinal planar middle portion 522, and curved side portions 504 extend upwardly from opposing longitudinal sides 522*a*, 522*b* of middle portion 522.

Each strain relief latch 506 includes a curved connecting portion 508 extending from a lateral side 502*c*, 502*d* of base portion 502 first curving upwardly and then curving downwardly and terminating at an arm portion 510 that extends downwardly. In at least one aspect, when strain relief 500 is used with electrical connector housing 100, arm portion extends in insertion direction A. Arm portion 510 is configured to resiliently deflect outwardly to accommodate secure attachment of strain relief 500 to an electrical connector. In at least one aspect, curved connecting portion 508 contributes to a suitable deflection, such as, e.g., 0.015" (0.38 mm), of arm portion 510, such that strain relief 500 can be easily installed to an electrical connector without yielding of strain relief latches 506. In at least one embodiment, to enable a low profile and a strong and stable strain relief, base portion 502 and strain relief latches 506 are integrally formed from sheet metal. An exemplary sheet metal material that can be used is stainless steel, although other suitable materials may be selected as suitable for the intended application. In at least one aspect, material properties are selected such that strain relief 500 can have a narrower width, which minimizes the additional width required for a latching mechanism on a mating connector.

In at least one embodiment, arm portion 510 includes opposing recesses 512 disposed in opposing side surfaces 514 thereof. Recesses 512 are configured to accommodate an inclined side surface of a ridge of the electrical connector, such as, e.g., inclined side surface 118 of ridge 110 of connector housing 100, as best illustrated in FIG. 13. As such, recesses 512 enable arm portion 510 to engage end portion 120 of ridge 110 for secure attachment of strain relief 500 to connector housing 100. In at least one aspect, during installation of strain relief 500 to connector housing 100, arm portion 510 engages inclined side surface 118 and, as a result, resiliently deflects outwardly. It then engages end portion 120 to complete the installation and securely attach strain relief 500 to connector housing 100. In at least one embodiment, to accommodate assembly of strain relief 500 to electrical connector 1, strain relief latches 506 include opposing ramp surfaces 526 positioned at an end 510*a* of arm portion 510.

In at least one embodiment, connecting portion 508 includes an opening 516, also referred to herein as first closed perimeter opening. Opening 516 is configured to receive a portion of a latch of a mating electrical connector, such as, e.g., securing portion 908 of latch 900 (FIGS. 17*a*-17*c*) of electrical connector 2, as best illustrated in FIG. 2. In at least one aspect, opening 516 receives securing portion 908 to secure strain relief 500 to connector housing 600 of electrical connector 2.

In at least one embodiment, arm portion 510 includes an opening 524, also referred to herein as second closed perimeter opening. Opening 524 is configured to increase the flexibility of arm portion 510. Opening 524 may have any suitable shape, such as, e.g., a racetrack shape (as illustrated, e.g., in FIG. 11*a*), a curvilinear shape, or a rectilinear shape. In at least one aspect, opening 524 contributes to more evenly distribute stress over strain relief latch 506, enabling a suitable deflection of strain relief latch 506 without yielding, e.g., during installation of strain relief 500. In at least one embodiment, first closed perimeter opening 516 is disposed between second closed perimeter opening 524 and longitudinal base portion 502, such that a latch that is deflected outwardly experiences a maximum stress that is less as compared to a latch that has the same construction except that it does not include second closed perimeter opening 524. In at least one embodiment, a region immediately adjacent second closed perimeter opening 524 experiences a maximum stress that is more as compared to a latch that has the same construction except that it does not include second closed perimeter opening 524.

Figure 19A:
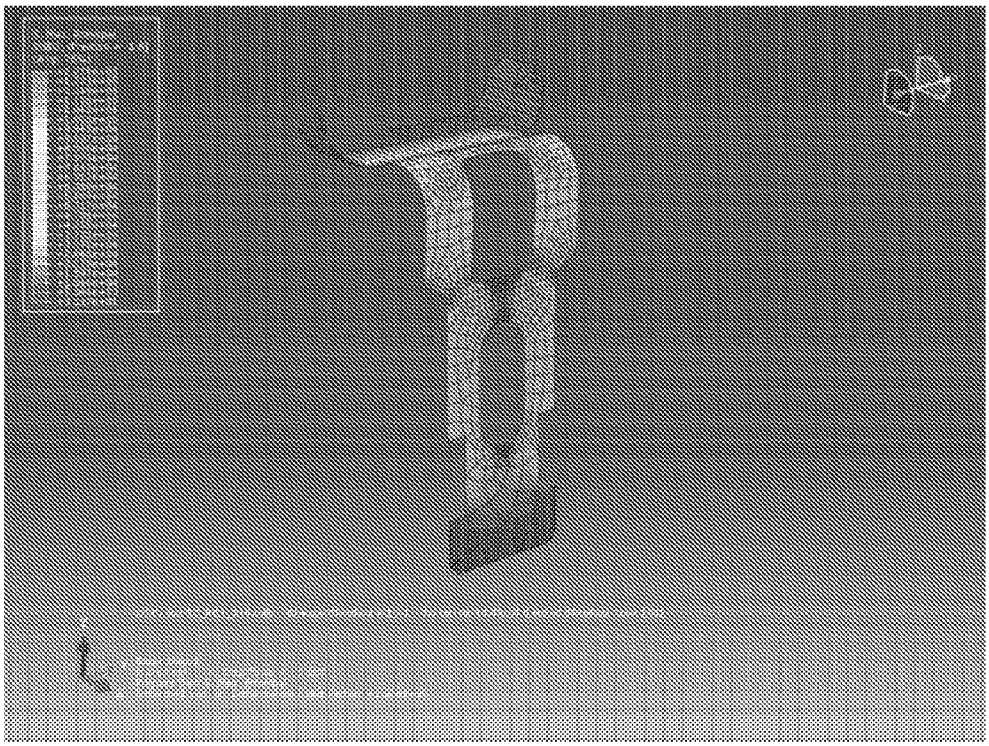
FIGS. 19*a*-19*b* are graphs illustrating the maximum stresses in exemplary embodiments of a strain relief according to aspects of the present invention.
Figure 19B:
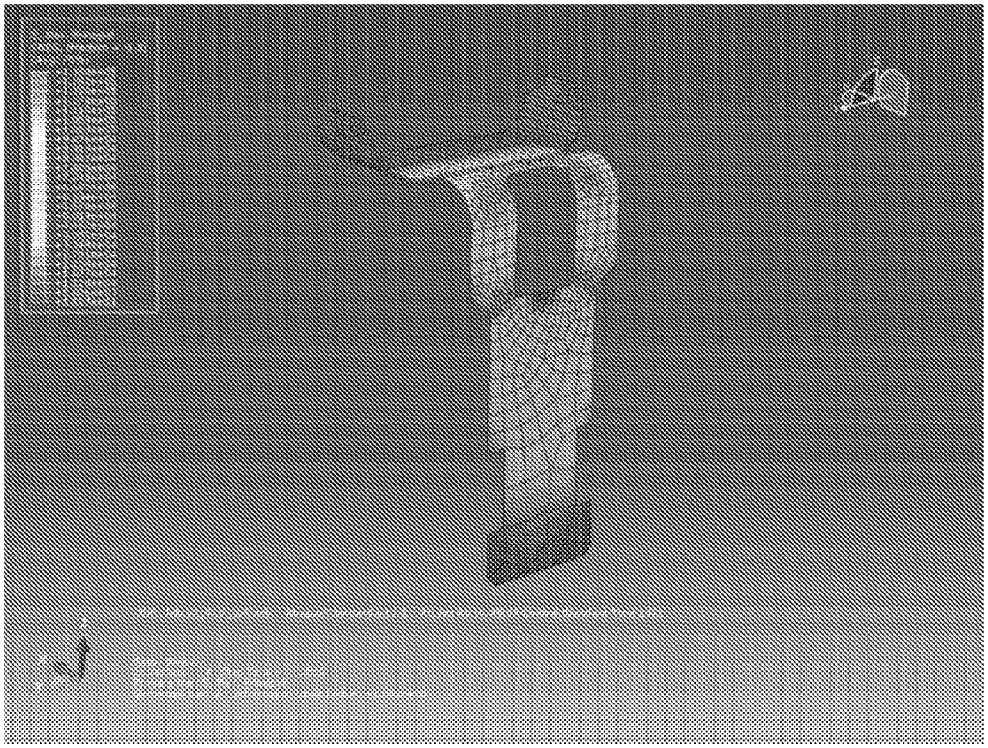

This is clearly illustrated in FIGS. 19*a*-19*b*, which are graphs illustrating the maximum stresses in a strain relief latch 506 with opening 524 (FIG. 19*a*) and an otherwise identical strain relief latch 506 without opening 524 (FIG. 19*b*). These graphs were created by first creating a Finite Element Analysis (FEA) model from the CAD geometry of the strain relief. The model was then imported into FEA modeling software, available under the trade designation Abaqus FEA from Simulia, Providence, R.I., U.S.A. Using displacement load constraints, a zero displacement was applied to base portion 502 thereby fixing the strain relief in space. Then, an outward displacement of up to 0.015" (0.38 mm) was applied on strain relief latch 506 at a point up from the end that represents the contacting surface of the latch when installed on a connector. The modeling software then examined the strain relief through the range of motion and displayed the resulting stress and strain. As illustrated in the graphs, the presence of opening 524 improves the maximum stress, which adds a safety margin from the material yield point. In at least one embodiment, the maximum stress is at least 1% less. In at least one embodiment, the maximum stress is at least 5% less (127K psi versus 133K psi as illustrated). As illustrated in the graphs, the presence of opening 524 also distributes the stress over a larger area rather than concentrating it on a small region, as illustrated by the increase in the maximum stress in a region immediately adjacent opening 524. In at least one embodiment, the maximum stress is at least 1% more. In at least one embodiment, the maximum stress is at least 5% more.

In at least one aspect, strain relief 500 and connector housing 100 are designed such that mating electrical connector 1 can mate with the same electrical connector, such as, e.g., electrical connector 2, with or without strain relief 500. In at least one aspect, strain relief 500 and connector housing 100 are designed such that the same latch, such as, e.g., latch 900, can latch to connector housing 100 with or without strain relief 500.

Figure 12:
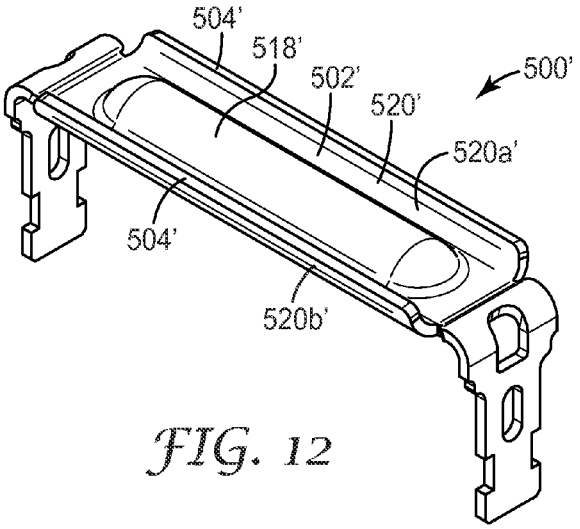
FIG. 12 is a perspective view of another exemplary embodiment of a strain relief according to an aspect of the present invention.

FIG. 12 illustrates another exemplary embodiment of a strain relief according to an aspect of the present invention. Referring to FIG. 12, strain relief 500' is similar to strain relief 500. In FIG. 12, elements of strain relief 500' that are similar to those of strain relief 500 have the same numbers but provided with a prime (') to indicate their association with strain relief 500'. In the embodiment illustrated in FIG. 12, base portion 502' includes a hollow dome-shaped portion 518' surrounded by a planar racetrack-shaped portion 520', and curved side portions 504' extend upwardly from opposing longitudinal sides 520*a*', 520*b*' of racetrack-shaped portion 520'. In at least one aspect, hollow dome-shaped portion 518' adds rigidity to strain relief 500' while allowing strain relief 500' to still have a lower profile (smaller thickness) than many conventional strain reliefs.

Figure 15:
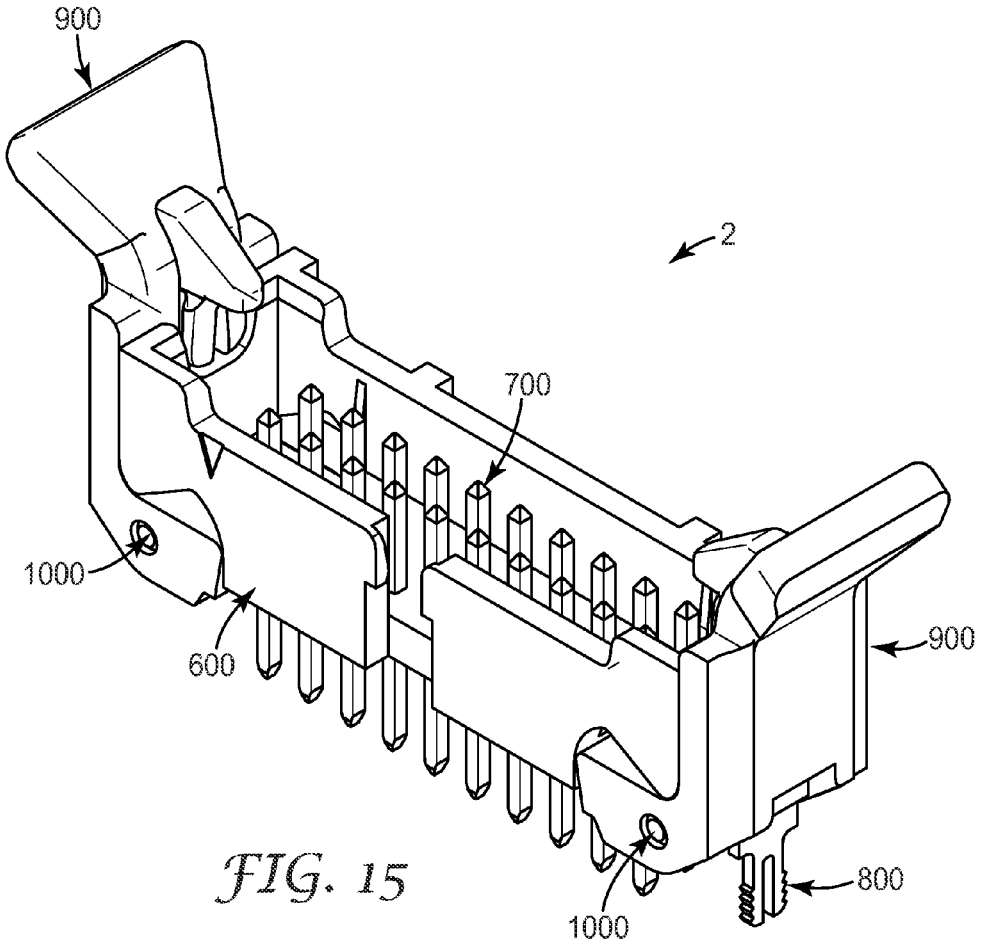
FIG. 15 is a perspective view of an exemplary embodiment of an electrical connector according to an aspect of the present invention.

FIGS. 14-15 illustrate an exemplary embodiment of an electrical connector according to an aspect of the present invention. Referring to FIGS. 14-15, electrical connector 2 includes an insulative connector housing 600 and a plurality of electrical contact pins 700 supported in connector housing 600. In at least one embodiment, electrical connector 2 further includes first and second retention clips 800 and/or first and second latches 900 and pivot pins 1000.

FIGS. 16*a*-16*e* illustrate an exemplary embodiment of an insulative connector housing according to an aspect of the present invention. Referring to FIGS. 16*a*-16*e*, insulative connector housing 600 includes a longitudinal bottom wall 602 having a plurality of contact openings 604. In at least one embodiment, electrical connector 2 includes a plurality of electrical contact pins 700 extending through contact openings 604 in insertion direction A. Connector housing 600 further includes first and second side walls 606, 608 extending upwardly from bottom wall 602 at opposing sides 602*a*, 602*b* of bottom wall 602, and first and second end walls 610, 612 extending upwardly from bottom wall 602 at opposing ends 602*c*, 602*d* of bottom wall 602. In at least one embodiment, side walls 606, 608 and end walls 610, 612 include chamfers 632 configured to accommodate engagement of a mating connector. In at least one aspect, chamfers 632 help guide a mating connector into connector housing 600 during mating.

Figure 16A:
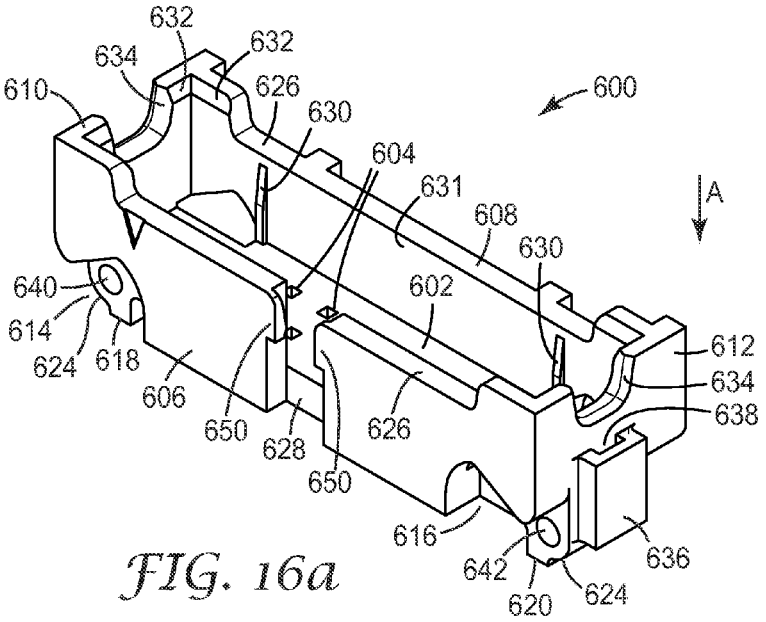
FIGS. 16*a*-16*e* are perspective, front, side, top, and bottom views, respectively, of an exemplary embodiment of a connector housing according to an aspect of the present invention.
Figure 16B:
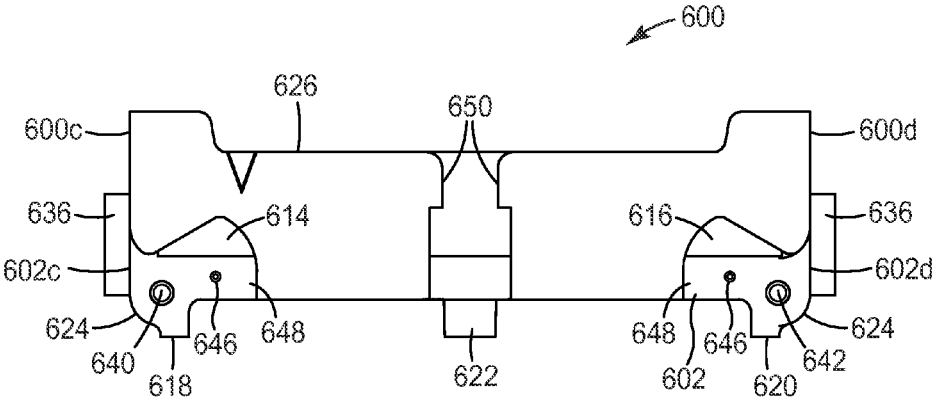
Figure 16C:
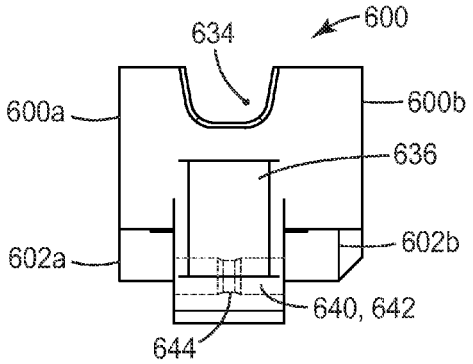
Figure 16D:
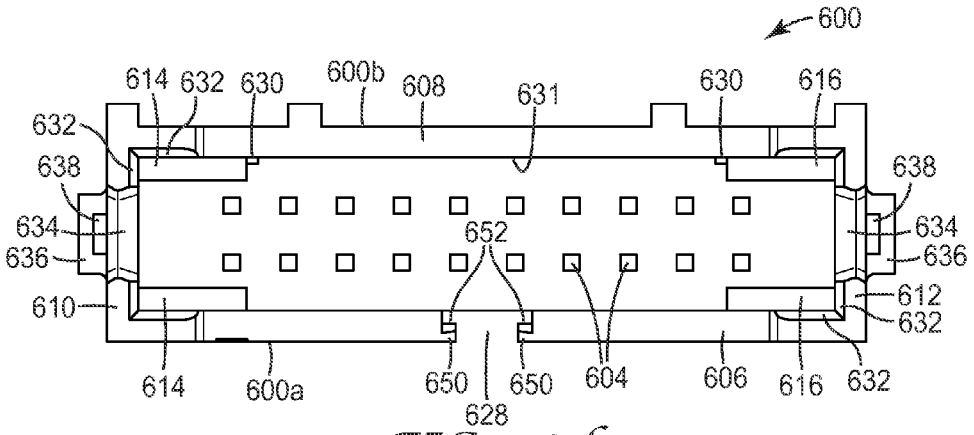
Figure 16E:
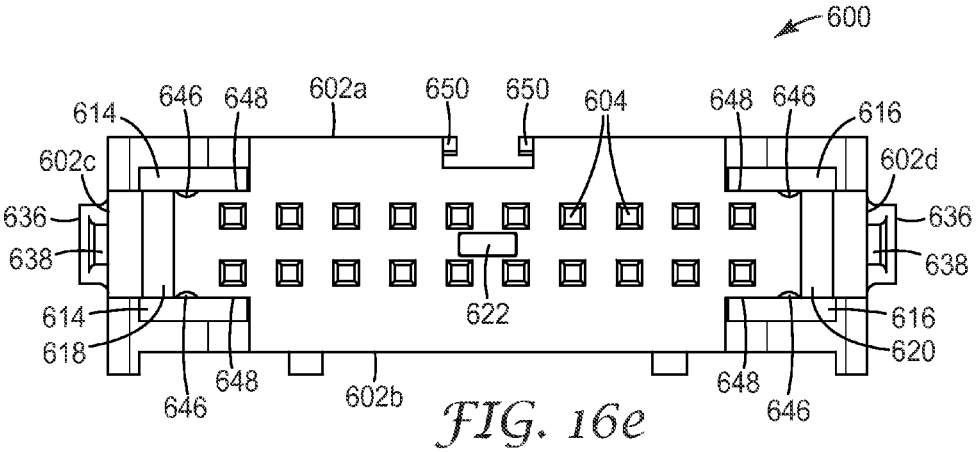

Connector housing 600 further includes first and second pairs of latch openings 614, 616 at opposing ends 602*c*, 602*d* of bottom wall 602. Each latch opening extends through bottom wall 602 and through a side wall and is configured to allow a latch, such as, e.g., latch 900, to eject a mating connector, such as, e.g., mating electrical connector 1, by moving within the opening. In at least one embodiment, the latch openings are shaped to accommodate a pivoting motion of a latch. In at least one aspect, in a configuration of electrical connector 2 wherein first and second latches 900 are present, the presence of first and second pairs of latch openings 614, 616 allows latches 900 to engage the pin field, i.e., the area configured to receive electrical contact pins, of electrical connector 2, which allows the overall length of this configuration of electrical connector 2 to be reduced. For example, in at least one embodiment, the connector housing has a length that is less than about 36 mm and includes at least 50 contact openings, and the latches add less than about 30% to the length of the electrical connector. This advantage of integrating latches 900 with connector housing 600 is best illustrated in FIG. 15. In at least one aspect, latches 900 engage the pin field of electrical connector 2 to eject a mating connector from electrical connector 2. To accommodate this, in at least one embodiment, the latch openings extend into bottom wall 602 beyond side walls 606, 608. In at least one embodiment, a portion of bottom wall 602 is positioned between at least one of the first and second pairs of latch openings 614, 616, which allows the pin field to be expanded to include an area between a pair of latch openings, as best illustrated in FIGS. 16*d*-16*e*.

In at least one embodiment, bottom wall 602 further includes first and second end standoffs 618, 620 extending downwardly therefrom at opposing ends 600*c*, 600*d* of connector housing 600. In at least one embodiment, bottom wall 602 further includes at least one center standoff 622 extending downwardly therefrom between opposing ends 600*c*, 600*d* of connector housing 600. In at least one aspect, first and second end standoffs 618, 620 and center standoff 622 are configured to properly support connector housing 600 on a printed circuit board (not shown), create a suitable space between bottom wall 602 of connector housing 600 and the printed circuit board, e.g., to enable soldering of electrical contact pins, allow the presence of printed circuit board components under connector housing 600, or allow the presence and pivoting of latches 900. First and second end standoffs 618, 620 and center standoff may have any suitable height.

Figure 17A:
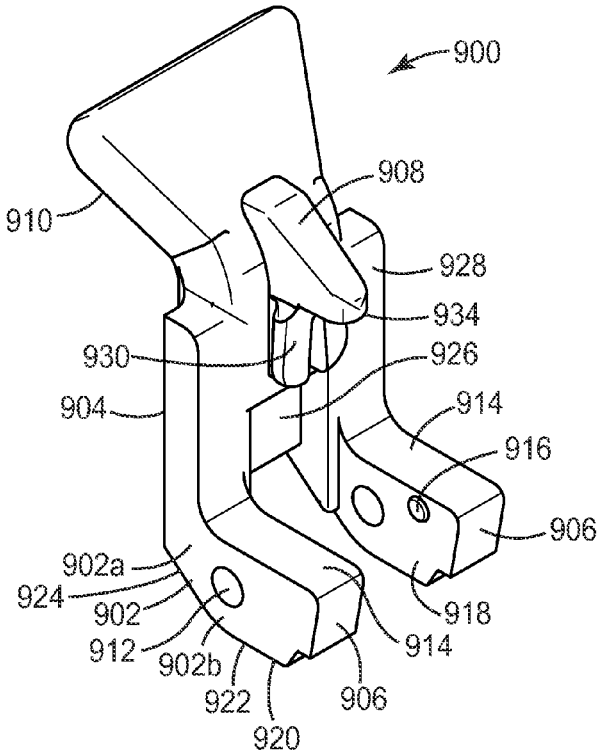
FIGS. 17*a*-17*c* are perspective, side, and top views, respectively, of an exemplary embodiment of a latch according to an aspect of the present invention.
Figure 17B:
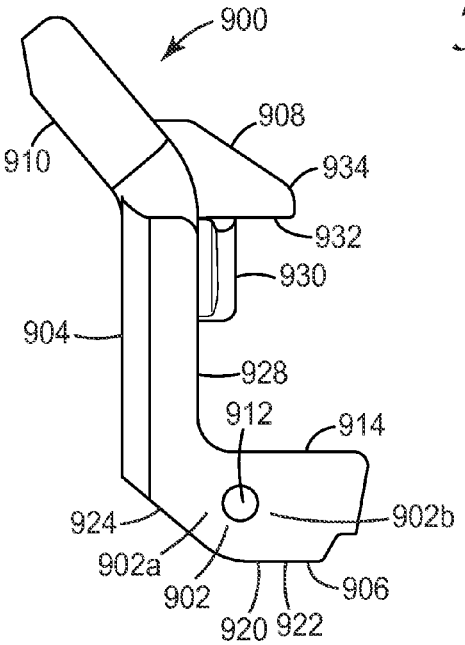
Figure 17C:
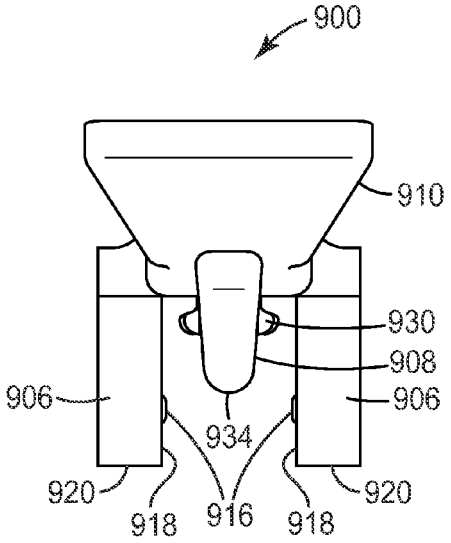

In at least one embodiment, bottom wall 602 further includes engagement edges 624 at opposing ends 600*c*, 600*d* thereof. Engagement edges 624 are shaped to engage with a portion of a latch, such as, e.g., second portion 924 of latch 900 (FIGS. 17*a*-17*c*). In at least one aspect, engagement edges 624 provide a stop for latch 900 to limit movement of the latch to an open position, e.g., as illustrated in FIG. 14. In at least one embodiment, bottom wall 602 includes a friction bump recess 646 in a side surface 648 thereof behind each latch opening. Friction bump recess 646 is configured to receive a friction bump of a latch, such as, e.g., friction bump 916 of latch 900 (FIGS. 17*a*-17*c*). In at least one aspect, friction bump recess 646 provides clearance for the friction bump, e.g., to facilitate installation of the latch to connector housing 600 or when the latch is in a closed or locked position, e.g., as illustrated in FIG. 15.

In at least one embodiment, side walls 606, 608 include an electrical conductor recess 626 between opposing ends 600*c*, 600*d* of connector housing 600. Electrical conductor recess 626 is configured to receive a portion of an electrical conductor, such as, e.g., electrical conductors 402 of electrical cable 400. In at least one aspect, electrical conductor recess 626 contributes to a lower profile or overall height of the mated configuration of electrical connector 2 and mating electrical connector 1, as best illustrated in FIG. 2.

In at least one embodiment, side wall 606 includes a polarization opening 628 at a middle thereof. Polarization opening 628 is configured to receive a portion of a polarization element of a mating connector, such as, e.g., polarization element 144 of connector housing 100 of mating electrical connector 1. In combination, polarization opening 628 and the polarization element prevent a mating electrical connector from being incorrectly, i.e., rotated 180° about insertion direction A, mated to electrical connector 2. In at least one embodiment, side wall 606 includes a pair of engagement elements 650 extending into polarization opening 628. Engagement elements 650 include an interior surface 652 configured to frictionally engage with a polarization element of a mating connector, such as, e.g., polarization element 144 of connector housing 100 of mating electrical connector 1. In this example, interior surface 652 is configured to frictionally engage with shorter ridge 150 of polarization element 144. In at least one aspect, this allows the mating connector to be securely attached to electrical connector 2, which is particularly useful in the absence of a separate latch/eject mechanism. In at least one embodiment, side wall 608 includes engagement ramps 630 extending from an interior surface 608*a* thereof. Engagement ramps 630 are configured to engage with a mating connector, such as, e.g., mating electrical connector 1. In at least one aspect, during insertion of mating electrical connector 1 in connector housing 600, engagement ramps 630 on side wall 608 direct mating electrical connector 1 toward side wall 606 to ensure suitable frictional engagement of shorter ridge 150 of polarization element 144 with interior surface 652 of engagement element 650 on side wall 606. Polarization opening 628, engagement elements 650, and engagement ramps 630 may be on either side wall at any suitable location.

In at least one embodiment, end walls 610, 612 include a slot 634 positioned between opposing sides 600*a*, 600*b* of connector housing 600. Slot 634 is configured to frictionally engage with a friction lock of a latch, such as, e.g., friction lock 930 of latch 900 (FIGS. 17*a*-17*c*). In combination, slot 634 and the friction lock retain the latch in a closed or locked position, e.g., as illustrated in FIG. 15, thereby keeping a mating connector securely locked to electrical connector 2, provide lateral stability to the latch, and resist lateral forces and forces in insertion direction A, e.g., when an electrical cable attached to the mating connector is pulled. In at least one embodiment, slot 624 has a curvilinear shape and the friction lock has a corresponding shape.

In at least one embodiment, electrical connector 2 includes first and second retention clips 800 attached to connector housing 600 at opposing ends 600*c*, 600*d* thereof. In at least one embodiment, end walls 610, 612 of connector housing 600 include a retention clip retainer 636. In at least one embodiment, retention clip retainer 636 is integrally formed with connector housing 600. Retention clip retainer 636 includes a retention clip opening 638 extending therethrough in insertion direction A. Retention clip opening 638 is configured to receive a portion of a retention clip, such as, e.g., retention clip 800 (FIG. 14). Retention clip 800 functions to retain electrical connector 2 to a printed circuit board. Retention clip 800 is an optional component; electrical connector 2 may be retained to a printed circuit board by any other suitable method or structure. For example, electrical connector 2 may be retained to a printed circuit board merely by electrical contact pins 700, e.g., by soldering or press-fit. Therefore, in at least one embodiment of electrical connector housing 600, retention clip retainer 636 is omitted. In at least one aspect, omitting retention clip retainer 636 reduces the length of connector housing 600. This is particularly beneficial in a configuration of electrical connector 2 wherein first and second latches 900 are not present, because it reduces the overall length of electrical connector 2.

In at least one embodiment, insulative connector housing 600 further includes first and second pivot pin holes 640, 642 extending through bottom wall 602 in a transverse direction perpendicular to insertion direction A at opposing ends 600*c*, 600*d* of connector housing 600. Pivot pin holes 640, 642 are configured to receive a portion of a pivot pin, such as, e.g., pivot pin 1000 (FIG. 14). In at least one embodiment, pivot pin holes 640, 642 include a restricted portion 644 configured to position and retain a pivot pin. For example, to position and retain pivot pin 1000, pivot pin holes 640, 642 include restricted portion 644 which corresponds to recessed portion 1002 of pivot pin 1000. In at least one aspect, during insertion of pivot pin 1000 in pivot pin holes 640, 642, first an end portion of pivot pin 1000 frictionally engages restricted portion 644, after which recessed portion 1002 engages restricted portion 644, which properly positions and pivotably retains pivot pin 1000 in connector housing 600.

In at least one embodiment, electrical connector 2 further includes first and second latches pivotably attached to connector housing 600 at opposing ends 600*c*, 600*d* thereof. Each latch is configured to secure a mating connector, such as, e.g., mating electrical connector 1, to connector housing 600, and eject a mating connector from connector housing 600. Advantages of the cooperative configuration of the latches and connector housing 600 include 1) a width of electrical connector 2 that is the same with or without the presence of the latches, 2) an overall length of electrical connector 2 that is minimally increased by the presence of the latches, 3) the ability for end walls 610, 612 of connector housing 600 to be present with or without the presence of the latches, which allows the use of the same connector housing 600 and therefore provides the same longitudinal alignment and blind mating capability for both connector configurations, and 4) a significant reduction in connector size and cost, to name a few.

In a configuration of a mating connector wherein a strain relief is present, each latch is configured to additionally secure the strain relief to connector housing 600. In at least one aspect, the latches advantageously operate in the same manner with or without the presence of a strain relief.

The latches are optional components; a mating connector may be secured to and removed from connector housing 600 by any other suitable method or structure. For example, a mating connector may be secured to connector housing 600 by a friction lock mechanism, such as, e.g., the combination of shorter ridge 150 of connector housing 100 of mating electrical connector 1 and interior surface 652 of connector housing 600. And, a mating connector may be removed from connector housing 600 by manual force, such as, e.g., by clamping mating electrical connector 1 between a human finger and thumb at flanges 130 of connector housing 100 and manually pulling it.

FIGS. 17*a*-17*c* illustrate an exemplary embodiment of a latch according to an aspect of the present invention. Referring to FIGS. 17*a*-17*c*, in at least one aspect, latch 900 is configured to secure a mating connector, such as, e.g., mating electrical connector 1, to connector housing 600, and eject a mating connector from connector housing 600. Latch 900 includes a hinge portion 902, an arm portion 904 extending from a first side 902*a* of hinge portion 902 along a first direction, and a pair of discrete spaced apart hinge arms 906 extending from an opposite second side 902*b* of hinge portion 902 along a second direction different than the first direction.

Hinge portion 902 is configured to pivotably attach latch 900 to connector housing 600. In at least one embodiment, hinge portion 902 includes a pivot hole 912 extending therethrough in a transverse direction perpendicular to the first direction. Pivot hole 912 is configured to receive a pivot pin, such as, e.g., pivot pin 1000. In at least one aspect, in combination, pivot hole 912 of latch 900, pivot hole 640, 642 of connector housing 600, and pivot pin 1000 provide a secure free moving latch 900 and a low cost hinge mechanism.

In at least one embodiment, arm portion 904 includes a recess 926 in an internal surface 928 thereof. Recess 926 is configured to accommodate a retention clip retainer, such as, e.g., retention clip retainer 636. In at least one aspect, recess 926 provides sufficient clearance for retention clip retainer 636 such that latch 900 can be brought into a closed or locked position, e.g., as illustrated in FIG. 15, without interference from retention clip retainer 636. In at least one embodiment, arm portion 904 includes a friction lock 930 extending from an internal surface 928 thereof. Friction lock 930 is configured to frictionally engage with a slot in an end wall of connector housing 600, such as, e.g., slot 634 in end walls 610, 612. In combination, friction lock 930 and the slot retain latch 900 in a closed or locked position, thereby keeping a mating connector securely locked to electrical connector 2, provide lateral stability to latch 900, and resist lateral forces and forces in insertion direction A, e.g., when an electrical cable attached to the mating connector is pulled. In at least one embodiment, friction lock 930 is substantially U-shaped and the slot has a corresponding shape.

Hinge arms 906 are configured to eject the mating connector through a pair of corresponding spaced apart latch openings 614, 616 extending through bottom wall 602 and through side walls 606, 608 of connector housing 600. In at least one embodiment, hinge arms 906 include an actuation surface 914 configured such that when the mating connector is inserted in connector housing 600, latch 900 pivots to a locked or closed position. To accommodate this pivoting motion, in at least one embodiment, actuation surface 914 is substantially planar, which in at least one aspect increases the leverage when pushing down on hinge arms 906. Advantageously, the presence of first and second latches 900 provides a total of four areas of actuation, which provides a greater bearing surface, and enables an even ejection and less binding during ejection of a mating connector. In at least one embodiment, hinge arms 906 are configured such that when latch 900 pivots to an open position, hinge arms 906 extend beyond a mating face of connector housing 600, which, in at least one aspect, enables ejection of a mating connector. In at least one embodiment, hinge arms 906 have a thickness substantially equal to a depth of latch openings 614, 616. In at least one embodiment, hinge arms 906 have a width substantially equal to a thickness of bottom wall 602. In at least one aspect, these thickness and width configurations of hinge arms 906 contribute to a reduced connector size. In at least one embodiment, hinge arms 906 include a friction bump 916 disposed on an internal surface 918 thereof. Friction bump 916 is configured to frictionally engage with side surface 648 of bottom wall 602. In at least one aspect, when latch 900 is in an open position, interference between friction bump 916 and internal surface 918 prevents latch 900 from unintentionally closing, although by frictionally engaging friction bump 916 with internal surface 648, latch 900 can be intentionally closed. In at least one embodiment, hinge arms 906 include a bottom surface 920 configured such that a first portion 922 thereof is substantially parallel to bottom wall 602 when latch 900 is in a closed position, and a second portion 924 thereof is substantially parallel to bottom wall 602 when latch 900 is in an open position. In at least one aspect, when electrical connector 2 is attached to a printed circuit board, first portion 922 and second portion 924 cooperate with the printed circuit board to provide a stop position for latch 900 corresponding to the closed position and the open position, respectively, to help prevent damage or breakage of the latching/ejecting mechanism or the connector housing of the electrical connector during normal operation while supporting the continuing miniaturization of electrical connectors.

In at least one embodiment, latch 900 further includes a securing portion 908. Securing portion 908 extends from arm portion 904 along a third direction different than the first direction. Securing portion 908 is adapted to secure the mating connector to connector housing 600. In at least one aspect, when securing mating electrical connector 1 to connector housing 600, securing portion 908 engages cover 300, specifically first and second cover latches 304, 306, of mating electrical connector 1. In at least one embodiment, securing portion 908 is adapted to additionally secure a strain relief, such as, e.g., strain relief 500, to connector housing 600. In at least one aspect, opening 516 of strain relief 500 receives securing portion 908 to secure strain relief 500 to connector housing 600 of electrical connector 2, as best illustrated in FIG. 2. In at least one embodiment, the third direction is parallel to the second direction. In at least one embodiment, securing portion 908 includes a connector engagement surface 932 substantially perpendicular to arm portion 904. In at least one embodiment, securing portion 908 includes a rounded end 934. In at least one aspect, these configurations of securing portion 908 ensure proper engaging and securing of the mating connector and, when present, the strain relief.

In at least one embodiment, latch 900 further includes an actuation portion 910 extending from arm portion 904. Actuation portion 910 is adapted to actuate latch 900. In at least one aspect, actuation portion 910 allows latch 900 to be easily manually operated, e.g., moved from a closed or locked position to an open position and vice versa. For example to accommodate easy manual operation of latch 900, in at least one embodiment, a width of actuation portion 910 increases as actuation portion 910 extends from arm portion 904, and in at least one embodiment, actuation portion 910 extends from arm portion 904 along a fourth direction different than the first direction.

In at least one embodiment, a width of arm portion 904, a width of hinge portion 902, a maximum width of actuation portion 910, and a width of connector housing 600 are substantially the same. In at least one aspect, this provides a reduced overall width of a configuration of electrical connector 2 wherein latches 900 are present.

Figure 18:
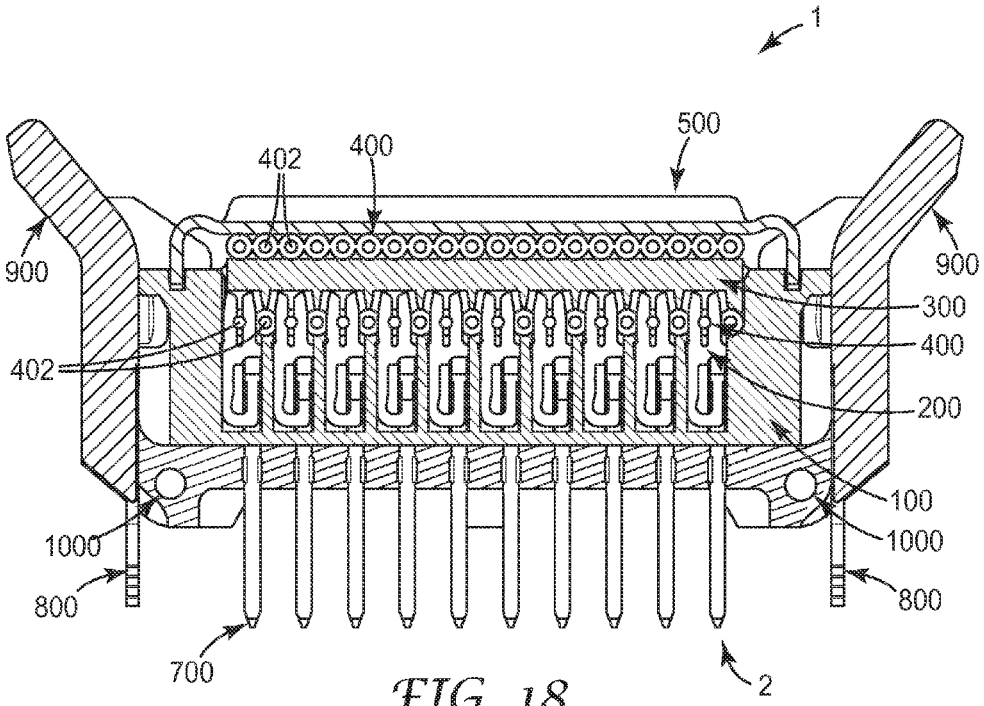
FIG. 18 is a cross-sectional view of an exemplary embodiment of an electrical connector system according to an aspect of the present invention in a mated configuration.

FIG. 18 illustrates mating electrical connector 1 and electrical connector 2 in a mated configuration. Specifically, it illustrates how in at least one embodiment, electrical conductors 402 of electrical cable 400 are retained between connector housing 100 and cover 300 and electrically connected to electrical contact terminals 200 supported in connector housing 100. It also illustrates how in at least one embodiment, electrical conductors 402 of electrical cable 400 are additionally retained between cover 300 and strain relief 500.

Following are exemplary embodiments of an electrical contact terminal according to aspects of the present invention.

Embodiment 1 is an electrical contact terminal comprising: a base portion for positioning and retaining the electrical contact terminal within a connector housing; an insulation displacement connecting portion extending upwardly from the base portion and comprising a pair of spaced apart arms defining an opening therebetween for receiving and making electrical contact with an electrical conductor; and a contact portion extending downwardly from the base portion and configured to float when the electrical contact terminal is retained and positioned within a connector housing, the contact portion comprising: a first arm extending downwardly and comprising a first end attached to the base portion and an opposite second end; a second arm extending downwardly and comprising a free first end closer to the base portion and an opposite second end farther from the base portion, the second arm being configured to deflect when making electrical contact with a mating contact pin; and an arcuate base portion connecting the second ends of the first and second arms.

Embodiment 2 is the electrical contact terminal of embodiment 1, wherein at least one of the first arm and the arcuate base portion is configured to deflect when the second arm makes electrical contact with a mating contact pin.

Embodiment 3 is the electrical contact terminal of embodiment 2, wherein the deflection includes a rotation about a longitudinal axis of the first arm.

Embodiment 4 is the electrical contact terminal of embodiment 1, wherein a width of the second arm tapers from the second end of the second arm to the free first end of the second arm.

Embodiment 5 is the electrical contact terminal of embodiment 1, wherein the first and second arms do not lie in a same plane.

Embodiment 6 is the electrical contact terminal of embodiment 1, wherein when the second arm deflects when making contact with a mating contact pin, the deflection creates a stress distribution that extends to the first arm.

Embodiment 7 is the electrical contact terminal of embodiment 6, wherein the stress distribution ranges from about 0 psi to about 165K psi.

Embodiment 8 is the electrical contact terminal of embodiment 6, wherein the stress distribution ranges from about 25K psi to about 165K psi.

Embodiment 9 is the electrical contact terminal of embodiment 1, wherein the contact portion is J-shaped.

Embodiment 10 is the electrical contact terminal of embodiment 1, wherein the contact portion is U-shaped.

Embodiment 11 is the electrical contact terminal of embodiment 1, wherein the contact portion can withstand a normal force of about 250 grams without yielding.

Embodiment 12 is the electrical contact terminal of embodiment 1, wherein the second arm includes a curvilinear contacting portion positioned at the free first end.

Embodiment 13 is the electrical contact terminal of embodiment 12, wherein the contacting portion faces away from the base portion.

Embodiment 14 is the electrical contact terminal of embodiment 1, wherein the second arm includes a rib configured to increase the stiffness of the second arm.

Embodiment 15 is the electrical contact terminal of embodiment 1, wherein the second arm is configured to deflect toward a major plane of the base portion when it makes electrical contact with a mating contact pin.

Embodiment 16 is the electrical contact terminal of embodiment 1, wherein the base portion includes a first retaining portion configured to retain and position the electrical contact terminal in a connector housing.

Embodiment 17 is the electrical contact terminal of embodiment 16, wherein the first retaining portion comprises a shell-shaped portion.

Embodiment 18 is the electrical contact terminal of embodiment 16, wherein the first retaining portion extends from a first major surface of the electrical contact terminal and is configured to retain and longitudinally position the electrical contact terminal in a connector housing.

Embodiment 19 is the electrical contact terminal of embodiment 16, wherein the first retaining portion is configured to prevent downward movement of the electrical contact terminal during termination of the electrical conductor.

Embodiment 20 is the electrical contact terminal of embodiment 1, wherein the base portion includes a second retaining portion configured to retain and position the electrical contact terminal in a connector housing.

Embodiment 21 is the electrical contact terminal of embodiment 20, wherein the second retaining portion comprises a wedge-shaped portion.

Embodiment 22 is the electrical contact terminal of embodiment 20, wherein the second retaining portion extends from a side surface of the base portion and is configured to retain and laterally position the electrical contact terminal in a connector housing.

Embodiment 23 is the electrical contact terminal of embodiment 1, wherein the first arm includes a third retaining portion configured to retain and position the electrical contact terminal in a connector housing.

Embodiment 24 is the electrical contact terminal of embodiment 23, wherein the third retaining portion comprises a curved portion.

Embodiment 25 is the electrical contact terminal of embodiment 23, wherein the third retaining portion extends from a second major surface of the electrical contact terminal and is configured to retain and laterally position the electrical contact terminal in a connector housing.

Embodiment 26 is the electrical contact terminal of embodiment 1, wherein the first arm and the base portion do not lie in a same plane.

Embodiment 27 is the electrical contact terminal of embodiment 26, wherein the second arm includes a curvilinear contacting portion positioned at the free first end.

Embodiment 28 is the electrical contact terminal of embodiment 27, wherein the contacting portion faces toward the base portion.

Embodiment 29 is the electrical contact terminal of embodiment 26, wherein the second arm is configured to deflect away from a major plane of the base portion when it makes electrical contact with a mating contact pin.

Embodiment 30 is an electrical contact terminal comprising: a base portion; an insulation displacement connecting portion extending upwardly from the base portion and comprising a pair of spaced apart arms defining an opening therebetween for receiving and making electrical contact with an electrical conductor; and a contact portion extending downwardly from the base portion and configured to float when the electrical contact terminal is retained and positioned within a connector housing, the contact portion comprising: a first arm extending forwardly at a first end of the contact portion attached to the base portion; and a second arm extending forwardly at an opposite second end of the contact portion, the first and second arms being configured to deflect when making electrical contact with a mating contact pin.

Embodiment 31 is the electrical contact terminal of embodiment 30, wherein the first and second arms extend at opposing sides of the contact portion.

Embodiment 32 is the electrical contact terminal of embodiment 30, wherein the first and second arms each include a curvilinear contacting portion extending from a major surface thereof.

Embodiment 33 is the electrical contact terminal of embodiment 32, wherein the contacting portions extend from the arms toward each other.

In each of the embodiments and implementations described herein, the various components of the electrical connector and elements thereof are formed of any suitable material. The materials are selected depending upon the intended application and may include both metals and non-metals (e.g., any one or combination of non-conductive materials including but not limited to polymers, glass, and ceramics). In at least one embodiment, some components, such as, e.g., latch 900 and electrically insulative components, such as, e.g., connector housing 100, cover 300, and connector housing 600, are formed of a polymeric material by methods such as injection molding, extrusion, casting, machining, and the like, while other components, such as, e.g., strain reliefs 500 and 500', retention clip 800, pivot pin 1000, and electrically conductive components, such as, e.g., electrical contact terminals 200, 200', and 200", electrical conductors 402, and electrical contact pins 700, are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Unless otherwise indicated, all numbers expressing quantities, measurement of properties, and so forth used in the specification and claims are to be understood as being modified by the term "about". Accordingly, unless indicated to the contrary, the numerical parameters set forth in the specification and claims are approximations that can vary depending on the desired properties sought to be obtained by those skilled in the art utilizing the teachings of the present application. Not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, to the extent any numerical values are set forth in specific examples described herein, they are reported as precisely as reasonably possible. Any numerical value, however, may well contain errors associated with testing or measurement limitations.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical contact terminal comprising:

a base portion for positioning and retaining the electrical contact terminal within a connector housing;

an insulation displacement connecting portion extending upwardly from the base portion and comprising a pair of spaced apart arms defining an opening therebetween for receiving and making electrical contact with an electrical conductor; and a contact portion extending downwardly from the base portion and configured to float when the electrical contact terminal is retained and positioned within a connector housing, the contact portion comprising:

a first arm extending downwardly and comprising a first end attached to the base portion and an opposite second end;

a second arm extending downwardly and comprising a free first end closer to the base portion and an opposite second end farther from the base portion, the second arm being configured to deflect when making electrical contact with a mating contact pin; and an arcuate base portion connecting the second ends of the first and second arms, wherein the base portion includes first and second retaining portions and the first arm includes a third retaining portion, and wherein the first, second and third retaining portions are configured to retain and position the electrical contact terminal in a connector housing.

2. The electrical contact terminal of claim 1, wherein at least one of the first arm and the arcuate base portion is configured to deflect when the second arm makes electrical contact with a mating contact pin.

3. The electrical contact terminal of claim 2, wherein the deflection includes a rotation about a longitudinal axis of the first arm.

4. The electrical contact terminal of claim 1, wherein a width of the second arm tapers from the second end of the second arm to the free first end of the second arm.

5. The electrical contact terminal of claim 1, wherein the first and second arms do not lie in a same plane.

6. The electrical contact terminal of claim 1, wherein when the second arm deflects when making contact with a mating contact pin, the deflection creates a stress distribution that extends to the first arm.

7. The electrical contact terminal of claim 6, wherein the stress distribution ranges from about 0 psi to about 165K psi.

8. The electrical contact terminal of claim 6, wherein the stress distribution ranges from about 25K psi to about 165K psi.

9. The electrical contact terminal of claim 1, wherein the contact portion is J-shaped.

10. The electrical contact terminal of claim 1, wherein the contact portion is U-shaped.

11. The electrical contact terminal of claim 1, wherein the contact portion can withstand a normal force of about 250 grams without yielding.

12. The electrical contact terminal of claim 1, wherein the second arm includes a curvilinear contacting portion positioned at the free first end.

13. The electrical contact terminal of claim 12, wherein the contacting portion faces away from the base portion.

14. The electrical contact terminal of claim 1, wherein the second arm includes a rib configured to increase the stiffness of the second arm.

15. The electrical contact terminal of claim 1, wherein the second arm is configured to deflect toward a major plane of the base portion when it makes electrical contact with a mating contact pin.

16. The electrical contact terminal of claim 1, wherein the first retaining portion comprises a shell-shaped portion.

17. The electrical contact terminal of claim 1, wherein the first retaining portion extends from a first major surface of the electrical contact terminal and is configured to retain and longitudinally position the electrical contact terminal in a connector housing.

18. The electrical contact terminal of claim 1, wherein the first retaining portion is configured to prevent downward movement of the electrical contact terminal during termination of the electrical conductor.

19. The electrical contact terminal of claim 1, wherein the second retaining portion comprises a wedge-shaped portion.

20. The electrical contact terminal of claim 1, wherein the second retaining portion extends from a side surface of the base portion and is configured to retain and laterally position the electrical contact terminal in a connector housing.

21. The electrical contact terminal of claim 1, wherein the third retaining portion comprises a curved portion.

22. The electrical contact terminal of claim 1, wherein the third retaining portion extends from a second major surface of the electrical contact terminal and is configured to retain and laterally position the electrical contact terminal in a connector housing.

23. The electrical contact terminal of claim 1, wherein the first arm and the base portion do not lie in a same plane.

24. The electrical contact terminal of claim 23, wherein the second arm includes a curvilinear contacting portion positioned at the free first end.

25. The electrical contact terminal of claim 24, wherein the contacting portion faces toward the base portion.

26. The electrical contact terminal of claim 23, wherein the second arm is configured to deflect away from a major plane of the base portion when it makes electrical contact with a mating contact pin.

27. An electrical contact terminal comprising:

a base portion;

an insulation displacement connecting portion extending upwardly from the base portion and comprising a pair of spaced apart arms defining an opening therebetween for receiving and making electrical contact with an electrical conductor; and a contact portion extending downwardly from the base portion and configured to float when the electrical contact terminal is retained and positioned within a connector housing, the contact portion comprising:

a first arm extending forwardly at a first end of the contact portion attached to the base portion; and a second arm extending forwardly at an opposite second end of the contact portion, the first and second arms being configured to deflect when making electrical contact with a mating contact pin.

28. The electrical contact terminal of claim 27, wherein the first and second arms extend at opposing sides of the contact portion.

29. The electrical contact terminal of claim 27, wherein the first and second arms each include a curvilinear contacting portion extending from a major surface thereof.

30. The electrical contact terminal of claim 29, wherein the contacting portions extend from the arms toward each other.

* * * * *